US006631243B2

(12) United States Patent
Reiker

(10) Patent No.: US 6,631,243 B2
(45) **Date of Patent: *Oct. 7, 2003**

(54) AIR RECIRCULATING AND HEATING DEVICE

(76) Inventor: Kenneth H. Reiker, 269 Country Club Dr., Shalimar, FL (US) 32579

( * ) Notice: Subject to any disclaimer, the term of this patent is extended or adjusted under 35 U.S.C. 154(b) by 71 days.

This patent is subject to a terminal disclaimer.

(21) Appl. No.: 10/021,131

(22) Filed: Oct. 22, 2001

(65) Prior Publication Data

US 2002/0064380 A1 May 30, 2002

Related U.S. Application Data

(63) Continuation-in-part of application No. 09/805,478, filed on Mar. 13, 2001, now Pat. No. 6,477,321, which is a continuation-in-part of application No. 09/598,855, filed on Jun. 21, 2000, which is a continuation of application No. 09/443,617, filed on Nov. 19, 1999, now Pat. No. 6,240,247, which is a continuation-in-part of application No. 09/439,763, filed on Nov. 15, 1999.

(60) Provisional application No. 60/262,491, filed on Jan. 17, 2001, provisional application No. 60/108,686, filed on Nov. 16, 1998, and provisional application No. 60/141,499, filed on Jun. 28, 1999.

(51) Int. Cl.[7] ..... F24H 3/00

(52) U.S. Cl. ..... 392/364; 416/5

(58) Field of Search ..... 392/360–369, 392/384, 385; 416/5, 95; 165/122, 125

(56) References Cited

U.S. PATENT DOCUMENTS

| | | | | | |
|---|---|---|---|---|---|
| 4,508,958 | A | * | 4/1985 | Kan et al. | 392/364 |
| 5,278,936 | A | * | 1/1994 | Shao | 392/365 |
| 5,668,920 | A | * | 9/1997 | Pelonis | 392/361 |
| 5,887,785 | A | * | 3/1999 | Yilmaz | 237/1 R |
| 6,240,247 | B1 | * | 5/2001 | Reiker | 392/364 |
| 6,366,733 | B1 | * | 4/2002 | Reiker | 392/364 |
| 6,438,322 | B1 | * | 8/2002 | Reiker | |
| 6,477,321 | B2 | * | 11/2002 | Reiker | 392/364 |

* cited by examiner

*Primary Examiner*—John A. Jeffery
(74) *Attorney, Agent, or Firm*—Myers & Kaplan, L.L.C.; Joel D. Myers

(57) ABSTRACT

A motorized fan of a heating module, mounted close to the ceiling of a room, draws the air from an upward location into the heating module through one or more inlets. The air drawn in is forced through and heated by one or more heating elements. The heated air is discharged as a heated primary airflow through one or more outlets. An auxiliary motor is preferably suspended from the heating module and supports one or more fan blades for producing an upwardly directed secondary airflow. The secondary airflow mixes with the primary airflow to produce a mixture of primary and secondary airflows having a temperature higher than that of the secondary airflow. The force of the secondary airflow causes the mixture of airflows to circulate throughout the room in a toroidal path to near uniformly heat the walls, windows and floor of the room and create an essentially uniform air temperature throughout the room.

99 Claims, 28 Drawing Sheets

AIR RECIRCULATING AND HEATING DEVICE

CROSS-REFERENCE AND PRIORITY CLAIM TO RELATED APPLICATIONS

To the full extent permitted by law, the present application claims priority to and the benefit of the following applications: 1) as a non-provisional application to provisional patent application entitled "Room Conditioner With Coaxial Fan And Heater Modules", filed on Jan. 17, 2001, having assigned Ser. No. 60/262,491; 2) as a continuation-in-part application of non-provisional application entitled "Ceiling Fan Room Conditioner With Ceiling Fan And Heater", filed Mar. 13, 2001, having assigned Ser. No. 09/805,478 now U.S. Pat. No. 6,477,321, which is a continuation of and claims priority to and benefit of non-provisional application entitled "Room Conditioner With Ceiling Mounted Heater", filed Nov. 19, 1999, having assigned Ser. No. 09/443,617 and having now issued as U.S. Pat. No. 6,240,247, which is a continuation-in-part of and claims priority to and benefit of non-provisional application entitled "Ceiling Fan With Attached Heater and Secondary Fan" filed on Nov. 15, 1999, having assigned Ser. No. 09/439,763 which claims priority to provisional application entitled "Stabilized Air Temperature Distribution Apparatus", filed on Nov. 16, 1998, having assigned Ser. No. 60/108,686; 3) as a continuation-in-part application of non-provisional application entitled "Ceiling Fan With Attached Heater and Secondary Fan" filed on Nov. 15, 1999, having assigned Ser. No. 09/439,763 which claims priority to and the benefit of provisional application entitled "Stabilized Air Temperature Distribution Apparatus", filed on Nov. 16, 1998, having assigned Ser. No. 60/108,686; and 4) as a continuation-in-part application of non-provisional application entitled "Ceiling Fan Having One Or More Fan Heaters" filed on Jun. 21, 2000, having assigned Ser. No. 09/598,855 which claims priority to and the benefit of provisional application entitled "Ceiling Fan Having Dual Fan Heaters", filed on Jun. 28, 1999, having assigned Ser. No. 60/141,499, wherein all above applications are incorporated herein by reference.

BACKGROUND OF THE INVENTION

1. Field of the Invention

The present invention relates to room conditioning units and, more particularly, to an air recirculating and heating device having a heating module for exhausting heated air as a primary airflow and for suspending an auxiliary motor rotating one or more fan blades to produce an upward secondary airflow for mixing with the primary airflow thereby resulting in an airflow that moves upward first against and across the ceiling, down the walls, across the floor and then back again into the same circulative airflow.

2. Description of Related Art

Years ago, heating of dwellings and offices was primarily by use of radiators having heated water flowing therethrough. Such heating was essentially practical only in buildings wherein a common boiler for heating water was practical. Dispersion of heat from the radiators was primarily a function of convective airflow. Unfortunately, due to the localized positioning of the radiators, cold and hot spots would exist in any room. Moreover, not only did the radiators impose constraints on furniture arrangement, they were also a risk for bodily injuries, especially for young children.

In an attempt to overcome the problems associated with radiator heating, central forced-air systems were proposed and are presently widely utilized. Due to their relatively inexpensive installation costs and lack of any adequate prior-art substitute, these systems have been used for a multitude of applications. However, in light of the present invention, central forced-air systems have many deficiencies. One of the most prominent deficiencies is its lack of thermal efficiency. Central forced-air systems require voluminous and lengthy ductwork. Consequently, heat loss results at the junctures of the ductwork and along the length thereof. For instance, the temperature of the air entering a room is substantially less than the air at the heating source such as a furnace. This substantial heat loss results in inefficient systems that require the use of excess amounts of energy (i.e., fuel, gas or electric), thus increasing its costs of operation.

In addition, central forced-air systems require the occupation of a relatively large space to heat an entire house or building, thus often occupying a substantial portion of the attic space and/or basement space. Furthermore, the duct outlets of central forced-air systems constrict furniture arrangement and produce hot and cold spots throughout a room, regardless of whether the outlets are wall mounted or ceiling mounted. Moreover, due to worldwide energy crises and the continual universal need to conserve energy, central forced-air systems are economically and socially disadvantageous.

As an alternative to central forced-air systems and radiator systems, electrically operated baseboard heaters have been proposed as a possible solution. However, baseboard heaters rely upon convection for dispersing the heated air and thereby result in inadequate heat distribution and the production of hot and cold spots. Moreover, furniture placement and activities within a room are constrained and risks of bodily and/or property damage are increased.

In an additional attempt to solve the above-mentioned deficiencies, ceiling fans having heaters suspended therefrom have been attempted. Although the general idea was good, prior-art attempts have failed to produce a viable solution. Such devices usually include a fan or the like for directing air heated by an electric heating element into the path of airflow produced by the ceiling fan. Unfortunately, however, The downward direction of airflow produced by the ceiling fan results in the creation of a hot spot beneath the ceiling fan and a significant temperature gradient from the center of a room to its perimeter. The resulting hot and cold spots are generally uncomfortable and are also unacceptable as furniture placement limitations are imposed.

Ceiling fans drawing heated air upwardly from a below mounted heater are also known. However, such ceiling fans are of little practical value since the fan motor tends to overheat and self-destruct relatively quickly. Another major factor contributing to the loss of efficiency has been the previous inability of ceiling fans to comfortably remove trapped warm air from the ceiling. As such, in addition to the small temperature gradient within the room, the occupant is quickly subjected to uncomfortable drafts from a ceiling fan alone. In addition to the failure of previous heating units to properly mix the required upward movement of air from the ceiling fan with an additional heated air source, cool airflow from off the blades of a stand-alone ceiling fan is typically greater than the warm air it pushes off the ceiling, thus leaving the occupant feeling uncomfortable.

More specifically, examples of ceiling fans having heaters suspended therefrom may be found by reference to U.S. Pat. No. 4,508,958 to Kan et al., U.S. Pat. No. 5,668,920 to Pelonis, U.S. Pat. No. 5,887,785 to Yilmaz and U.S. Pat. No.

4,694,142 to Glucksman. However, in light of the present invention, the aforementioned designs are deficient in that they either fail to evenly distribute heated air throughout the room and thus result in cold spots and hot spots, or they fail to protect the fan motors from adverse heat generated from improperly isolated heating elements and/or deficient airflow design.

For instance, Kan et al. discloses a ceiling fan with adjacently mounted heating elements on the primary fan motor. Such proximity of the heating elements usually results in the adverse overheating of the fan motor and its consequential destruction. The Kan et al. patent fails to employ a heat sink barrier or to isolate the heating elements from the motorized components therefore subjecting the rotor, stator and bearings of the fan motor to non-isolated heat conditions. Further, the Kan et al. design and positioning of the secondary fan blades from the rotor hinders adequate air supply, thus yielding poor distribution of heated air and unwanted cold spots and hot spots throughout the room.

The Pelonis and Yilmaz patents disclose ceiling fans containing both a ceiling fan motor and a heater fan motor. However, due to the design of the Pelonis and Yilmaz inventions, both inventions fail to ensure isolation of the heating elements from the fan motors, thereby causing the subsequent overheating and malfunction of the same. Further, the design of the Pelonis invention essentially amounts to the fan motor blowing heated air in a directly downward fashion instead of an ideal circulating fashion, leaving unwanted cold spots throughout the room.

The Glucksman patent discloses an axial fan in coaxial alignment with an electric resistance heater. The Glucksman invention possesses not only the main elements of a space heater, but also the inadequacies and inefficiencies associated therewith. More specifically, the Glucksman design fails to uniformly distribute its produced heated air throughout a room. Therefore, the inherent deficiency in the Glucksman design yields intense and uncomfortable hot air adjacent to the space heater and uncomfortable and unwanted cold air/spots in areas removed from the space heater.

An additional deficiency in the above references is that many of the ceiling fan/heater devices fail to disclose an adequate means for obtaining and controlling a desired temperature at various elevations. More specifically, with prior systems, the temperature at a standard standing height can often be several degrees higher than at the floor level. Unfortunately, wall-mounted thermostats are often mounted at the standard standing height level and only accurately reflect the temperature at that level. As such, if the occupants are sitting on the floor or on a sofa, the wall-mounted thermostat does not reflect the desired temperature at such a level. Moreover, manually operated controls typically require constant manual adjustments depending on the occupant's elevation.

Therefore, it is readily apparent that a new and improved air recirculating and heating device is needed wherein a consistent and adequate near uniform distribution of heated air is provided without subjecting the fan motors to adverse heat elevations, and wherein any desired temperature at any desired elevation may be easily obtained. It is, therefore, to the provision of such an improvement that the present invention is directed.

SUMMARY OF THE INVENTION

The present invention is directed to an air recirculating and heating device having a heating module preferably adapted from an upward location for drawing in air, heating the air and discharging it as a primary airflow through one or more outlets. An auxiliary motor suspended from the heating module and adapted to support one or more fan blades rotates to produce an upward secondary airflow for mixing with the primary airflow. It should be noted that the naming of the two separate airflows, one primary and one secondary, is for descriptive and differentiating purposes only. Reversing or renaming those airflows has no impact upon the function or operation of the device. Upon such mixing, the temperature of the secondary airflow is raised. The force of the secondary airflow is sufficient to cause a flow of air omni-directionally across the ceiling, down along the windows and walls, across the floor and upwardly beneath the heating module. Windows are notorious cold spots due to a layer of chilled air molecules adjacent the glass. The force of the heated airflow tends to scrub off the low temperature air molecules adjacent the glass and impart heat to the glass through conduction, thereby eliminating the windows as cold spots. One or more selectively actuated heating elements are disposed in the heating module. Only the number of heating elements necessary as a function of the ambient temperature in the room to quickly bring the temperature of the air in the room to a desired comfort level are energized in response to a control unit. Upon achieving such comfort level, the number of energized heating elements may be reduced to a point where the heating elements perform essentially a temperature maintaining function. When a cooling effect, rather than a heating effect is desired, the heating module is turned off and the rotation of the auxiliary motor is reversed to produce a downward, rather than an upward, airflow.

One or more light fixtures may be adapted from the structure attendant the auxiliary motor. A manual or automatic remote control unit may be employed to selectively control the operation of the heating module, the auxiliary fan and any utilized light fixtures.

A feature and advantage of the present invention is its ability to provide an air recirculating and heating device for maintaining the air in a room at a near uniform constant predetermined temperature, thereby overcoming the inefficiencies of conventional systems.

A feature and advantage of the present invention is its ability to efficiently function without ductwork, wherein such ductwork has been proven to loose 30 to 40% of its efficiency through placement in a cold attic, through pressure loss due to distance from the conventional heating source and through requisite negotiation of multiple 90 degree angle changes in direction before being exhausted into an airspace.

A feature and advantage of the present invention is its ability to provide a method of heating only specified rooms or areas within a home or office. By using such a method, the occupant can regulate the temperature of each room rather than attempting to regulate an entire home with a conventional centrally mounted thermostat. Additionally, due to the rapid response and efficiency provided by the device, only those rooms in use need to be heated, while those not in use, can be closed off and heated just prior to their intended use and/or occupation.

A feature and advantage of the present invention is its ability to provide an air recirculating and heating device for heating air drawn from near the ceiling of a room and dispersing the heated airflow in a vertically circular manner, first against and across the ceiling, then down the walls and across the floor throughout the room, and then back up toward the ceiling.

A feature and advantage of the present invention is its ability to provide an air recirculating and heating device having an auxiliary motor with fan blades attached thereto, wherein the auxiliary motor is suspended from a heating module supported from the ceiling of a room.

A feature and advantage of the present invention is its ability to provide a heating module supported from an upward location for suspending an auxiliary motor, wherein the auxiliary motor has fan blades and a light fixture attached thereto.

A feature and advantage of the present invention is its ability to provide an air recirculating and heating device for heating air and dispersing the heated air throughout a room. With each cycle, the molecules of air are stimulated by the heating elements and retain additional heat.

A feature and advantage of the present invention is its ability to provide a method of continual stimulation of the heated air molecules for distribution throughout a room that results in large eddies of air colliding and transferring their heated energy to achieve near uniform room temperatures.

A feature and advantage of the present invention is its ability to provide a method for recirculating heated air within a room by producing a primary airflow of heated air via a heating module drawing air from near the ceiling, wherein the expelled primary heated airflow is mixed with an upward secondary airflow generated by at least one fan blade attached to an auxiliary motor suspended from the heating module.

A feature and advantage of the present invention is its ability to provide an efficient apparatus and method of heating a room that does not hinder floor space and thus furniture arrangement.

A feature and advantage of the present invention is its ability to provide a heating module for adapting an auxiliary motor, at least one fan blade(s) and an optional light fixture.

A feature and advantage of the present invention is its ability to provide an air recirculating and heating device for dispersing heated air nearly uniform throughout a room and maintaining the air in the room at a preset desired temperature under control of either an automatic or a manual control unit. The process of maintaining temperature, rather than letting it dissipate before reheating, more efficiently allocates energy to the home environment while achieving constant comfort levels void of rising and falling temperatures associated with traditional thermostatic control.

A feature and advantage of the present invention is its ability to provide a method for recirculating heated air within a room by producing a primary airflow of heated air via a heating module, wherein the primary heated air is mixed with a preferably upward secondary airflow generated by at least one fan blade adapted to an auxiliary motor adapted from the heating module.

A feature and advantage of the present invention is its ability to provide an air recirculating and heating system that can be remotely operable.

A feature and advantage of the present invention is its ability to provide an air recirculating and heating system that can include a portable control unit having a thermostat that can be positioned at a user's elevation, thereby providing accurate desired temperature control.

These and other objects, features and advantages of the present invention will become apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures in which like reference numerals denote similar structures and refer like elements throughout, and in which.

DESCRIPTION OF THE PREFERRED EMBODIMENT

In describing the preferred and various alternate embodiments of the present invention, as illustrated in the Figures and/or described herein, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
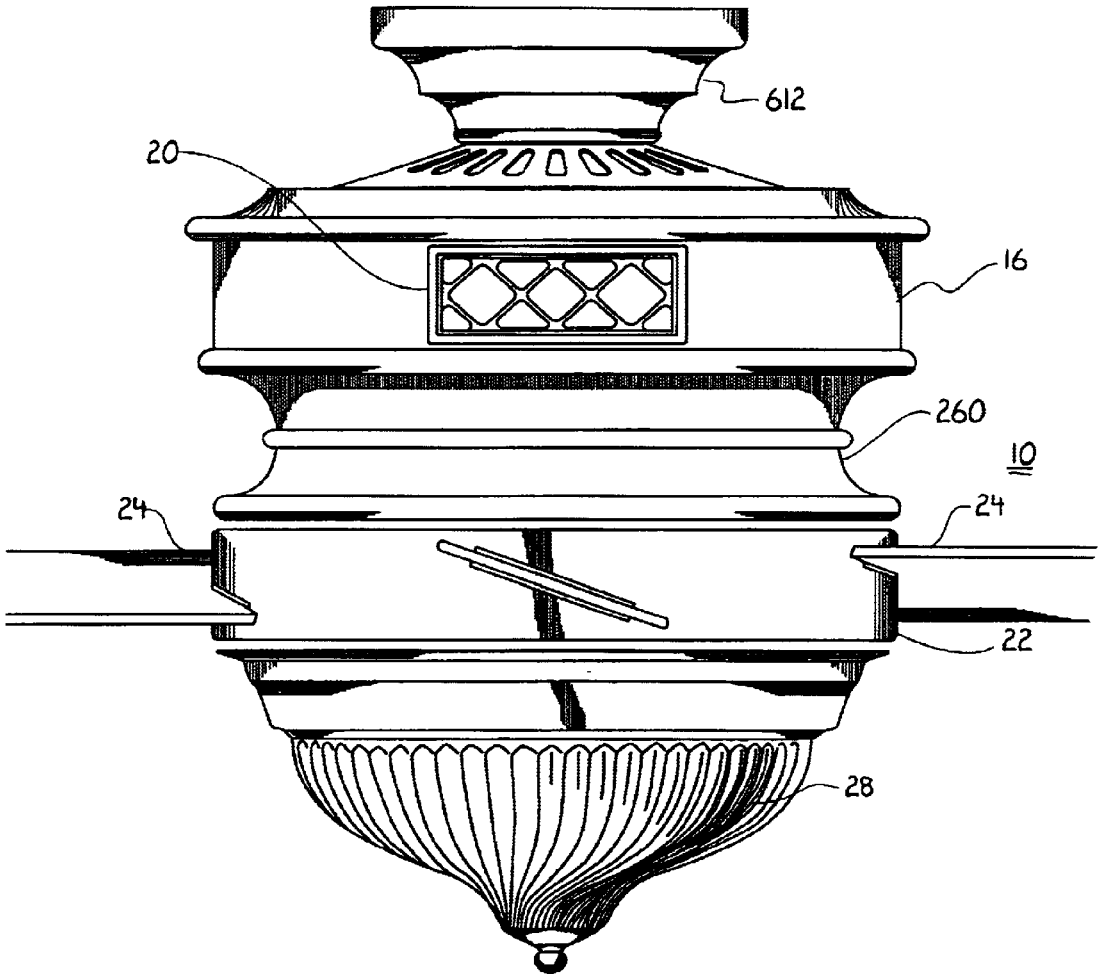
FIG. 1 is a side view of an air recirculating and heating device according to a preferred embodiment of the present invention showing the device housed within one of several optional decorative housings.

Referring now to FIG. 1, there is illustrated a preferred air recirculating and heating device 10 enclosed within optional decorative elements or housings. It is to be understood that the exterior configuration illustrated is simply one of a multitude of decorative exterior configurations that may be utilized. Device 10 is preferably adapted from an upward location within a room, such as the ceiling of the room, wherein a preferred cover 612 may be optionally incorporated to shield the supporting and attachment mechanisms. Device 10 further comprises a preferred heating module 16, wherein heating module 16 has preferred outlets 20 disposed thereabout. Outlets 20 preferably provide a primary airflow path for heated air as a function of the amount of heating to be performed. A preferred auxiliary fan module 22 preferably comprises a preferred auxiliary fan motor 116 for rotating fan blades 24 to produce a secondary airflow, wherein secondary airflow is preferably upward during a heating phase and preferably downward during a cooling phase. An optional decorative shroud 260 is preferably disposed between heating module 16 and auxiliary fan module 22 and an optional light module 28 is preferably adapted to auxiliary fan module 22.

Figure 2:
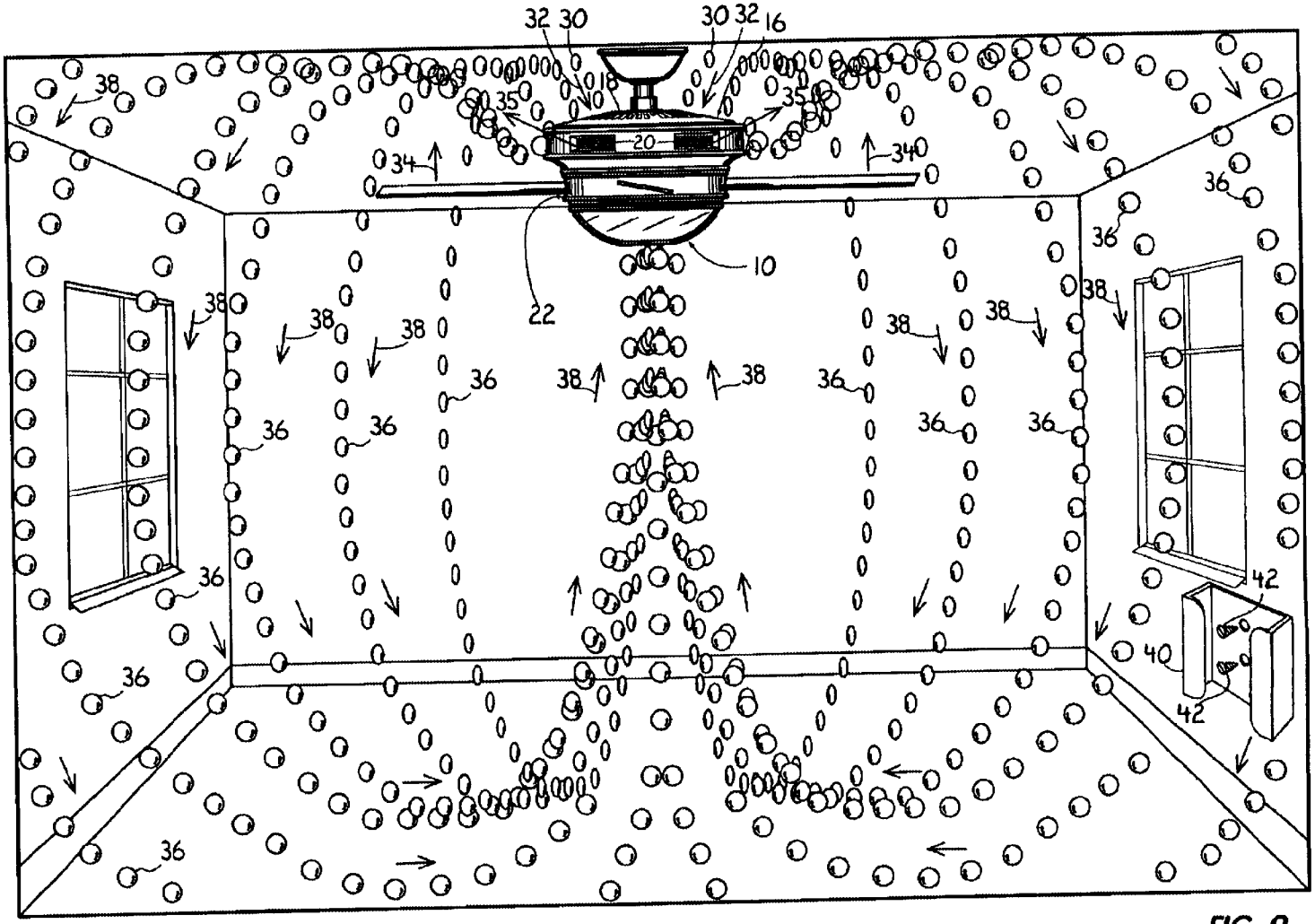
FIG. 2 illustrates the airflow within a room resulting from operation of an air recirculating and heating device according to a preferred embodiment of the present invention.

Now referring to FIG. 2, there is illustrated the preferred operation of air recirculating and heating device 10 when operating in the heating phase. Upon energization of heating module 16, molecules of air, represented by a stream of circles 30, are moved through preferred inlets 18 disposed on heating module 16, as representatively depicted by arrows 32. These molecules of air are heated within heating module 16 and exhausted as a primary heated airflow 35 through outlets 20. Upon energization of heating module 16, auxiliary fan module 22 is also energized to produce an upward secondary airflow 34, as depicted by arrows 34. Upward secondary airflow 34 preferably mixes with primary heated airflow 35 as secondary airflow 34 flows upwardly toward the ceiling of the room. As depicted by a plurality of streams of molecules 36, the mixture of primary and secondary airflow preferably flows upwardly toward the ceiling, along the ceiling, downwardly along the walls, across the floor and upwardly beneath air recirculating and heating device 10. This movement of heated air molecules 36 is designated by arrows 38 appearing throughout FIG. 2.

Windows of a room are historically and notoriously responsible for adjacent cold spots resulting in downwardly flowing air thereby causing discomfort to an occupant in proximity to the window. As depicted in FIG. 2, the energy of heated air molecules 36 is sufficient to cause a scrubbing action as it flows adjacent the window(s) thereby resulting in the dislodging of the cold air molecule layer. Through such dislodgment, the cold air molecules are replaced with warm air molecules on a continuing basis resulting in warming of the window. Such removal of the cold air molecules and warming of the interior window surface will essentially eliminate the cold spots formerly associated with each window. As heated air molecules 36 continuously move throughout the room, a near uniform air temperature throughout the room corresponding with a preset desired temperature is preferably established and maintained without the production of unwanted hot and/or cold spots. Moreover, it is less expensive to maintain a desired temperature for a room having near uniform temperatures.

A preferably portable control unit for setting the desired room temperature is provided, wherein portable control unit preferably comprises a thermostat and controls for selectively activating device 10. Consequently, a user can position portable control unit at an elevation (i.e., floor, sofa or standing) that more accurately reflects his desired temperature at said level, thereby ensuring that device 10 is controlled accurately to provide the desired temperature. In an alternate embodiment, the control unit may be attached to a wall of the room at a convenient location. The preferred or alternate embodiment of the control unit may be either automatically operated or manually operated. For illustrative purposes, a holder 40 (not to scale for purposes of clarity) for holding control unit may be attached to a wall or other convenient surface by screws 42 or the like. The control unit is preferably a wireless unit preferably using transmitted radio frequency (RF) signals preferably received by a receiver disposed within air recirculating and heating device 10. Alternatively, other means for wireless transmission such as, for exemplary purposes only, infrared (IR) signals or any means known within the art may be utilized. Such transmitter/receiver control unit eliminates the need for rewiring the wall and ceiling, which is of particular benefit when installing an air recirculating and heating device 10 in an existing building. It should also be noted that the RF signals transmitted could be at different frequencies for various air recirculating and heating devices such that different control units will control different air recirculating and heating devices. It is further contemplated that if infrared or other short-range signal control unit is utilized, one control unit could be utilized to operate a multitude of air recirculating and heating devices, wherein the control unit is in relatively close proximity thereto. Alternatively, an RF or IR signal could be encoded to minimize inadvertent operation of another air recirculating and heating device. Additionally, a single control unit could have controls for selectively controlling a multitude of air recirculating and heating devices.

Figure 3A:
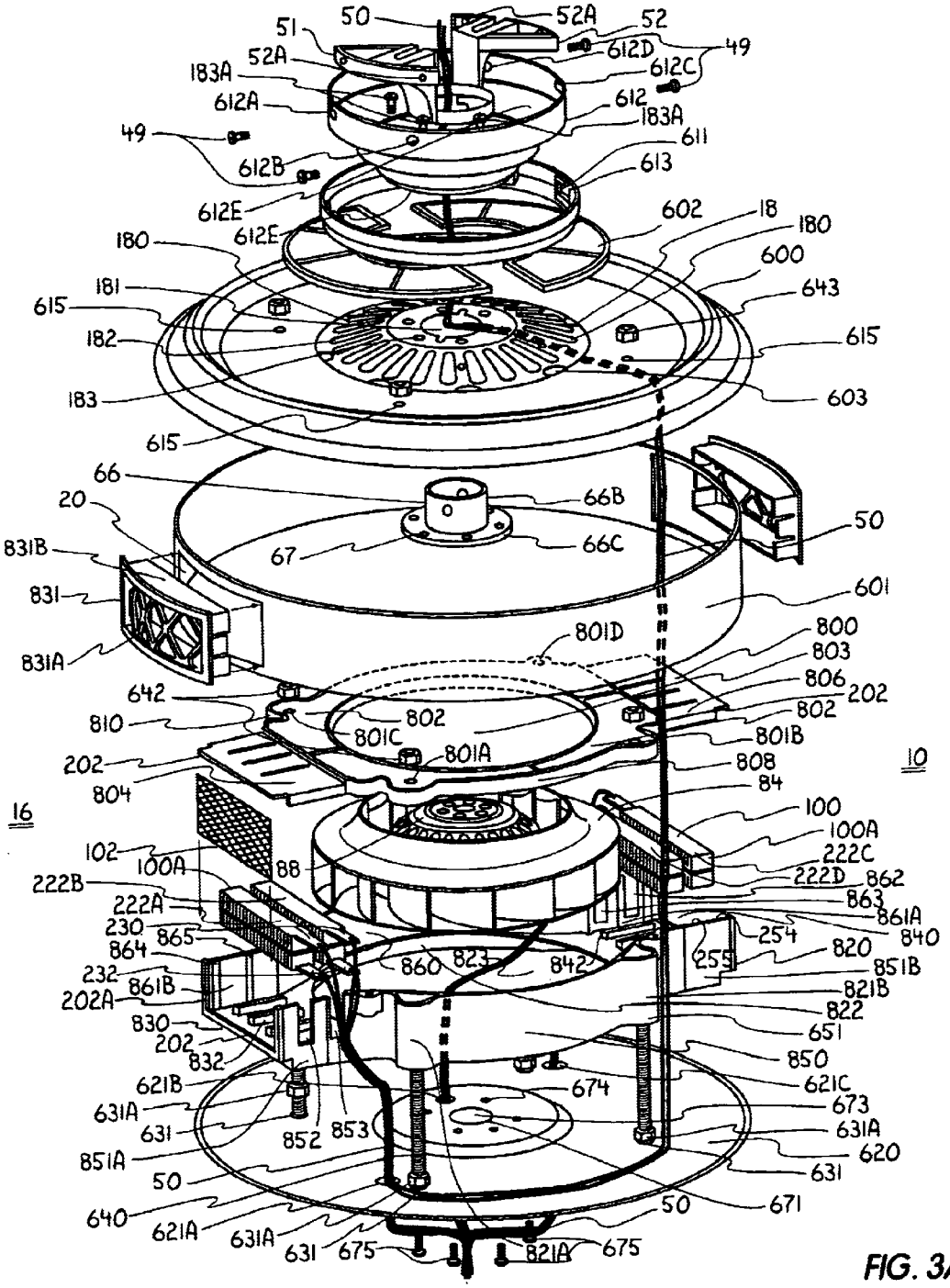
FIGS. 3A and 3B are exploded views of an air recirculating and heating device according to a preferred embodiment of the present invention.
Figure 3B:
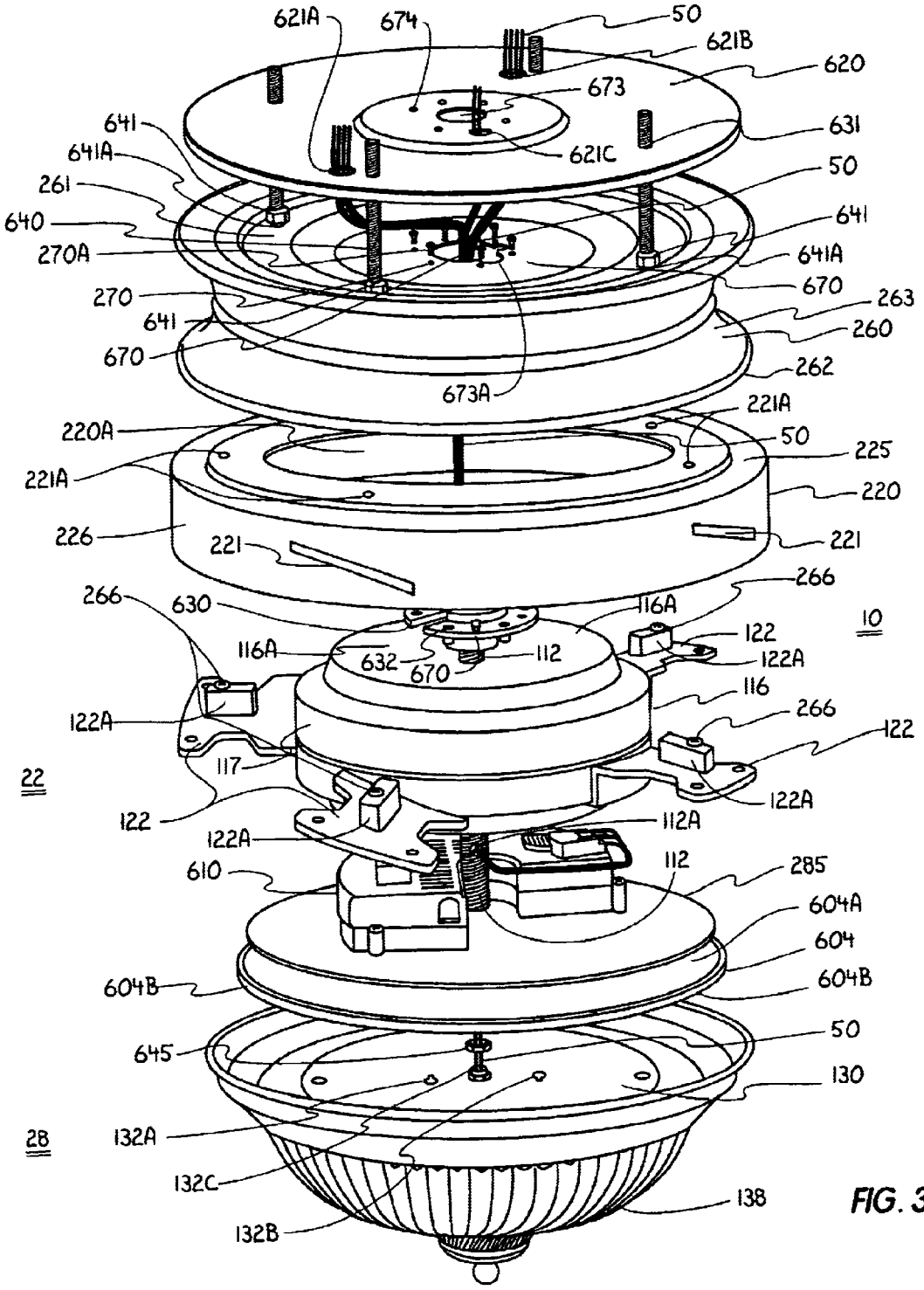
Figure 3C:
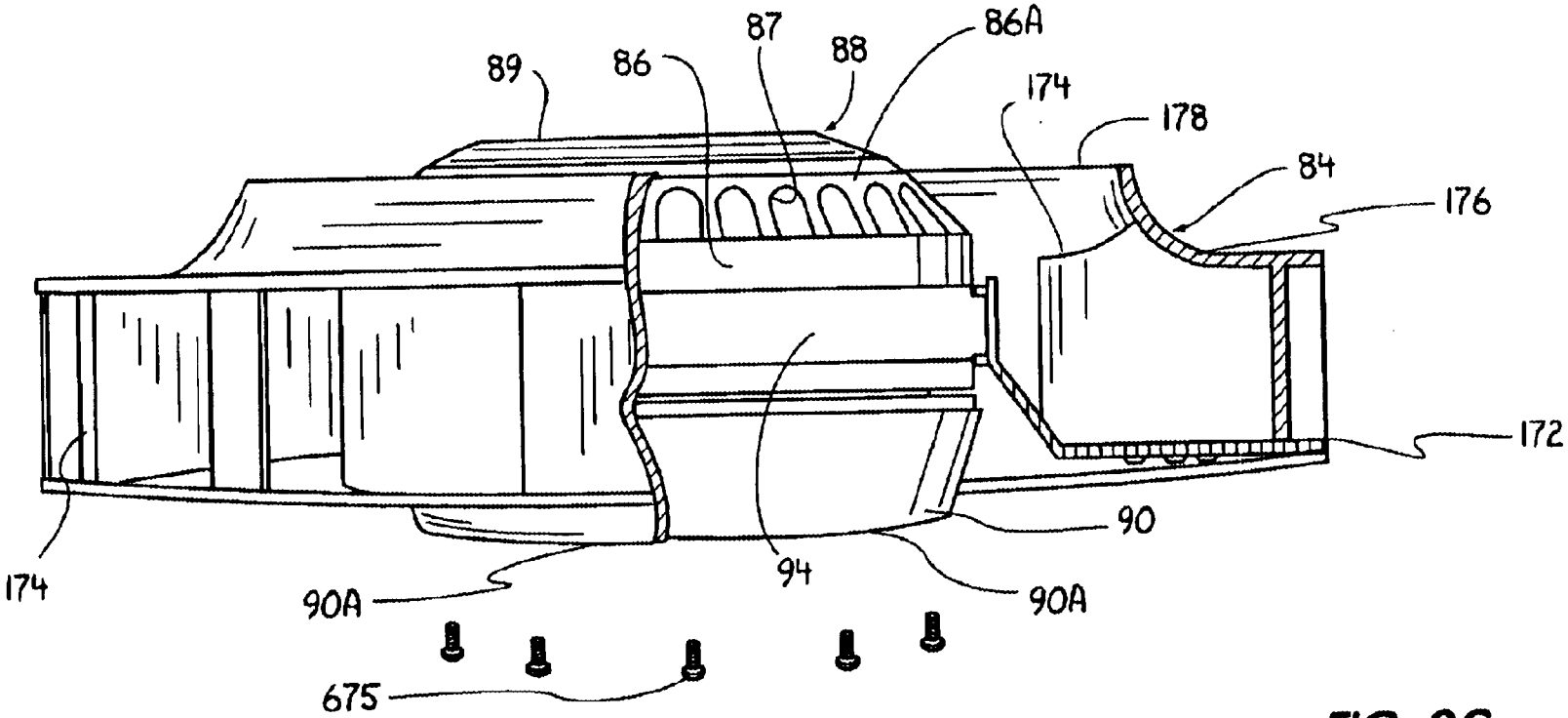
FIG. 3C is a partial cross-sectional view of an impeller and motor of an air recirculating and heating device according to a preferred embodiment of the present invention.

The presently preferred embodiment of the air recirculating and heating device 10 is illustrated in FIGS. 3A–3C. Referring now specifically to FIG. 3A, a preferred support means 51 is preferably housed within cover 612, wherein support means 51 preferably comprises a preferred bracket 52 preferably attached to a conventional electrical box (not shown) and further attached to a joist in the ceiling or similar support member. A plurality of electrical conductors 50 are preferably electrically connected to a source of power within the ceiling and channeled through cover 612 as well as through the length of device 10 so as to provide power to the various electrical components of device 10. Cover 612 is preferably bowl shaped and preferably has a preferred passage 612E centrally positioned and defined therethrough for the passage of electrical conductors 50 therethrough. Cover 612 is preferably attached to bracket 52 preferably via insertion of preferred screws 49 into preferred throughholes 612A, 612B, 612C and 612D formed around the upper periphery of cover 612, and thereafter through preferred throughholes 52A formed on bracket 52. A preferred dress ring 613, comprising preferred slots 611 is then slid over cover 612 and turned such that slots 611 slidably engage screws 49. Dress ring 613 preferably serves to both cosmetically cover screws 49 and prevent the unwanted loosening of screws 49.

Heating module 16 preferably generally comprises a preferred upper support plate 600, a preferred lower support plate 620, a preferred inlet ring 601, a preferred upper heat shield 800, a preferred lower heat shield 820, a preferred motor 88, a preferred impeller 84 and preferred heating elements 100. Upper support plate 600 is preferably circular shaped and has a preferably centrally located shallow preferred cone section 180, wherein cone section 180 further has a preferred boss aperture 181 centrally positioned thereon and dimensioned for receiving a preferred boss 66. Preferably radially positioned around boss aperture 181 is a plurality of preferred radial slots 182 defining inlets 18 for airflow therethrough and into heating module 16 for heating. Located between radial slots 182 and boss aperture 181 are a plurality of preferred throughholes 183, wherein throughholes 183 are aligned with preferred throughholes 612F (not shown) positioned on the lower end of preferred cover 612, and wherein throughholes 183 are aligned with preferred throughholes 67 on preferred boss 66. Insertion of screws 183A through throughholes 612F, through throughholes 183 and through throughholes 67 secures upper support plate 600 between cover 612 and boss 66.

Specifically, upper support plate 600 is attached to boss 66 by sliding preferred head portion 66B of boss 66 through boss aperture 181 and aligning throughholes 183 of upper support plate 600 with throughholes 67 found on rim portion 66C of boss 66 and attaching the two via preferred screws 183A.

Preferably covering inlets 18 is a preferred filter 602, wherein filter 602 is preferably two C-shaped filters that are held in place by preferred tabs 603 located around the periphery of cone section 180. Filter 602 preferably serves to prevent accumulation of dust on the internal components of heating module 16.

Lower support plate 620 is preferably circular shaped and has a preferably centrally located preferred mounting section 671, wherein mounting section 671 further has a preferred aperture 673 centrally positioned thereon and dimensioned for receiving the lower mounting location of motor 88 of impeller 84. Preferably radially positioned around aperture 673 is a plurality of preferred throughholes 674 for preferably attaching motor 88 and impeller 84 to mounting section 671 via preferred screws 675. Extending around mounting section 671 are preferably four equally spaced preferred throughholes 631 that are dimensioned to preferably each receive one of four preferred threaded posts 640, wherein threaded posts 640 stem from and are adapted to preferred decorative shroud 260 positioned below lower support plate 620, and wherein threaded posts 640 further function to secure all components of heating module 16 together. Lower support plate 620 further comprises preferably three preferred throughholes 621A, 621B and 621C for the channeling therethrough of electrical conductors 50 to the various electrical components of device 10.

Positioned on and adapted to lower support plate 620 is preferred lower heat shield 820, wherein lower heat shield 820 comprises a generally circular shaped preferred body 822 having preferably two opposing substantially rectangular preferred planks 830 and 840 attached thereto. Body 822 preferably has a preferred aperture 823 centrally formed therethrough to permit contact between mounting section 671 of lower support plate 620 with motor 88 and impeller 84 and for attachment thereto via attaching screws 675. Extending around the periphery of body 822 and planks 830 and 840 are preferred walls 850 and 860, wherein wall 850 further comprises integrally formed preferred channels 821A and 821B and wall 860 further comprises integrally formed preferred channels 821C and 821D. Channels 821A–821D are dimensioned to receive threaded posts 640 when heating module 16, and device 10 in general, is being assembled.

A preferred wall portion 851A of wall 850 proximal to plank 830 comprises preferred slots 852 and 853 formed thereon, and a preferred wall portion 861A of wall 860 proximal to plank 840 comprises preferred slots 862 and 863 formed thereon, wherein slots 852, 853, 862 and 863 are dimensioned to snuggly receive preferred tabs 230 and 232 of each preferred heating element 100. Furthermore, a preferred wall portion 851B of wall 850 proximal to plank 840 comprises preferred ridges 854 and 855 (not shown) formed thereon, and a preferred wall portion 861B of wall 860 proximal to plank 830 comprises preferred ridges 864 and 865 formed thereon, wherein the slots formed by ridges 854, 855, 864 and 865 are dimensioned to snuggly receive preferred ends 100A of each heating element 100. The distal ends of each plank 830 and 840 have a preferred slot 202 formed therein, wherein slot 202 is contiguous with preferred slots 202A formed on the distal ends of walls 850 and 860. Slots 202 and 202A are dimensioned to snuggly receive preferred protective screens 102, wherein protective screens 102 function to prohibit direct access to heating elements 100, yet still permit the egression of primary heated air 35 therethrough.

Preferably two juxtaposed preferred heating elements 222A and 222B are positioned on plank 830 and further rest on preferred supports 832 formed on plank 830. Likewise, preferably two juxtaposed preferred heating elements 222C and 222D are positioned on plank 840 and further rest on preferred supports 842 formed on plank 840. When heating elements 222A and 222B are positioned on plank 830, tabs 230 and 232 of heating element 222A are situated within slot 852 and tabs 230 and 232 of heating element 222B are situated within slot 853. Similarly, when heating elements 222C and 222D are positioned on planks 840, tabs 230 and 232 of heating element 222C are situated within slot 862 and tabs 230 and 232 of heating element 222D are situated within slot 863. Heating elements 222A–222D are preferably generally elongated rectangular in shape and are dimensioned to be received within the confinements created by planks 830 and 840 and walls 850 and 860 of lower heat shield 820.

Referring now specifically to FIG. 3C, preferred impeller 84 and accompanying preferred motor 88 are illustrated, wherein impeller 84 and accompanying motor 88 are preferably positioned within body 822 of lower heat shield 820. Impeller 84 and accompanying motor 88 are preferably generally circular shaped and dimensioned to fit within the confinements inherent in the size of lower heat shield 820. Preferably, a preferred stator 90 of impeller 84 is mounted to mounting section 671 of lower heat shield 820 via insertion of screws 675 through throughholes 674 in mounting section 671 and into preferred holes 90A (not shown) of stator 90. In communication with stator 90 is a preferred rotor 86 having a preferred mounting 94 for attachment to a cylindrical segment of a preferred base 172 of impeller 84. Rotor 86 preferably includes a plurality of preferred apertures 87 formed in preferred upper housing 86A of rotor 86; further apertures, not shown, may be formed in top central preferred surface 89 of rotor 86. These apertures serve a primary purpose of ventilating preferred motor 88 to prevent a destructive heat build up. Preferably, a plurality of preferred curved vanes 174 extend upwardly from base 172 and are attached to a preferred upper member 176 defining a preferred circular opening 178, wherein circular opening 178 defines an inlet for impeller 84 from which air is drawn. Vanes 174, base 172 and upper member 176 may be constructed as separate components of similar or dissimilar material or molded as a single unit of the same material. Preferably, impeller 84 draws air through inlets 18 in upper support plate 600, pulling it through circular opening 178 and then exhausting the air laterally past heating elements 222A–222B and through outlets 20 proximal to heat shields 800 and 820.

It should be noted that there are various other configurations and combinations of fan and motor assemblies such as, for exemplary purposes only, brushless motors, motors with stators and rotors, squirrel cage, blower, impeller fans and any other known means or devices that may be utilized. It should be construed that preferred impeller 84 with preferred motor 88 and its stator 90 and rotor 86 configuration as described herein to create a primary airflow could be any or all of the possible configurations described above or their equivalence and remain within the scope of the present invention. It is to be understood that preferably motor 88 and impeller 84 are commercially available from appropriate sources.

Referring again to FIG. 3A, heating elements 222A–222D, impeller 84 and accompanying motor 88 and protective screens 102 carried by lower heat shield 820 are covered by a preferred upper heat shield 800, wherein upper heat shield 800 caps lower heat shield 820. Upper heat shield 800 comprises a generally circular shaped preferred body 802 having preferably two opposing substantially rectangular preferred planks 804 and 806 attached thereto. Body 802 preferably has a preferred aperture 803 centrally formed therethrough to permit impeller 84 to draw air therefrom and into heating module 16. Extending around the periphery of body 802 and planks 804 and 806 are preferred lips 808 and 810. Upper heat shield 800 in general is of the same shape of lower heat shield 820, but is fractionally larger than lower heat shield 820 such that when upper heat shield 800 is brought into contact with lower heat shield 820, lip 808 sits over wall 850 of lower heat shield 820, lip 810 sits over wall 860 of lower heat shield 820, and preferably four throughholes 801A–801D formed on body 802 and around the periphery of aperture 803 are aligned with channels 821A–D, respectively, of lower heat shield 820. Moreover, when upper heat shield 800 is joined with lower heat shield 820 is such a manner, the distal ends of planks 804 and 806 have defined thereunder slots 202 (not shown), dimensioned to fit over protective screens 102.

Although thermally insulative material, such as high temperature plastic or ceramic, is the preferred material for heat shields 800 and 820, there are various other methods and materials contemplated for isolating heating elements 100 (i.e., 222A–222D) from components affected by adverse heat. Among them, but not limited to, are other thermally insulative materials, heat sink heat shield materials, reflective materials and distance from adjacent components and their equivalence. There are also various electric heating elements 100 that may serve the same purpose. Among them, but not limited to, are PTC, ceramic, coiled wire or any other known method or materials including their equivalence. Denying consumer access, as a safety precaution, to heating elements 100 can be performed in various ways. Among them, but not limited to, are screens such as screens 102, bars, molded plastic, wire mesh or any other known methods or devices including their equivalence. It should be construed that the preferred heat shields 800 and 820, heating elements 100 and screens 102 as used in this specification implies that any or all of the possible elements, listed above and their equivalence, are within the scope of the invention.

Preferably positioned around the joined upper and lower heat shields 800 and 820, respectively, is preferred inlet ring 601, wherein inlet ring 601 is a substantially circular flat ring defining preferably two opposing substantially rectangular outlets 20. When inlet ring 601 is placed around combined upper and lower heat shields 800 and 820, respectively, outlets 20 are aligned with protective screens 102. Outlets 20 each further carry a preferred insert 831 having a preferred screened end 831A attached to a preferred insert end 831B, wherein insert end 831B is dimensioned to fit within outlet 20 and abut heat shields 800 and 820 upon full insertion of insert 831, thereby ensuring the complete channeling and exhaustion of primary heated airflow 35 past heating elements 100, through insert end 831B and outlets 20 and past screened end 831A for mixture with secondary airflow 34.

Combined inlet ring 601 and heat shields 800 and 820 with enclosed impeller 84, motor 88, heating elements 100 and protective screens 102, are then secured between upper and lower support plates 600 and 620, respectively, via the aid of threaded posts 640. Threaded posts 640 extend first from support shroud 260 (as shown in FIG. 3B) and then through throughholes 631 of lower support plate 620, wherein lower support plate 620 is further secured by preferred nuts 631A thereto. Threaded posts 640 then extend through channels 821A–821D of lower heat shield 820, each channel 821A–821D receiving one threaded post 640. Threaded posts 640 next extend through throughholes 801A–801D of upper heat shield 800, each of throughholes 801A–801D receiving one threaded post, and are secured thereto via preferred nuts 642. Threaded posts 640 are finally extended through throughholes 615 on upper support plate 600 and secured thereto via preferred nuts 643, thereby securing inlet ring 601 between upper and lower support plates 600 and 602, respectively, such that inlet ring 601 encircles heat shields 800 and 820, thus securingly housing within heat shields 800 and 820 impeller 84, motor 88, heating elements 100 and protective screens 102.

Referring now specifically to FIG. 3B, preferred decorative shroud 260 is preferably circular shaped, comprising a preferred upper wall 261 joined to a preferably concave preferred peripheral wall 263, forming a hollow enclosure for partially housing auxiliary fan motor 116. Threaded posts 640 extended into holes 641A formed preferably on upper wall 261 and are secured thereto via preferred nuts 641, wherein nuts 641 further function as spacers to provide the proper mounting height for the mounting of lower support plate 620 to decorative shroud 260. Upper wall 261 preferably comprises a recessed mounting section 670, wherein mounting section 670 preferably defines preferred coupler aperture 673A centrally positioned thereon and dimensioned for receiving the upper end of a coupler 630 of auxiliary fan module 22 for secured mounting and support of auxiliary fan module 22 thereto. Preferably radially positioned around coupler aperture 673A is a plurality of preferred throughholes 270 for preferably attaching coupler 630 thereto via preferred screws 270A. Coupler aperture 673A further functions as a passageway for extension of electrical conductors 50 therethrough.

Decorative ring 220 is preferably circular shaped and preferably comprises a preferred top surface 225 joined to a preferred peripheral wall 226, wherein preferably four preferred throughholes 221A are formed around the periphery of top surface 225. Peripheral wall 226 preferably comprises four equally spaced preferred slots 221 dimensioned to each receive one of preferably four preferred fan blades 24 (see FIG. 1) adapted to preferred brackets 122, wherein brackets 122 are further adapted to auxiliary fan motor 116. Decorative ring 220 further defines a centrally positioned preferred aperture 220A for extension of electrical conductors 50 therethrough and for receiving upper portion 116A of auxiliary fan motor 116. Decorative ring 220 further functions to hide from view brackets 122 and auxiliary fan motor 116. Decorative ring 220 is attached to brackets 122 via insertion of preferred screws 266 through preferred throughholes 221A and into preferred spacers 122A positioned on brackets 122. As such, in operation, decorative ring 220 rotates in unison with auxiliary fan motor 116.

Auxiliary fan module 22 preferably comprises auxiliary fan motor 116, wherein auxiliary fan motor 116 is preferably a conventional auxiliary fan motor assembly and preferably includes a preferred rotor 117 rotatably secured to a preferred hollow shaft 112 through preferred bearings 118 and 120 (see FIG. 26), wherein hollow shaft 112 extends through the length of auxiliary fan motor 116 and auxiliary fan module 22. A preferred stator 90 (not shown) of auxiliary fan motor 116 is preferably attached to hollow shaft 112. Each of fan blade brackets 122 is attached to rotor 117, wherein each fan blade bracket 122 preferably supports fan blades 24 (not shown). Fan blade brackets 122 are conventional fan blade brackets known within the art. The hollowness of shaft 112 provides for the routing of electrical conductors 50 therethrough and out of a throughhole 112A formed on shaft 112 for connection with preferred remote control receiver unit 610. Threadably engaged to the portion of hollow shaft 112 that extends past upper portion 116A of auxiliary fan motor 116 is preferred coupler 630, wherein coupler 630 is preferably generally disk shaped and has a plurality of preferred throughholes 632 formed thereon. Throughholes 632 of coupler 630 align with throughholes 270 of mounting section 670 of shroud 260 so that upon insertion of preferred screws 270A into throughholes 632 and 670, auxiliary fan module 22 is secured and supported to shroud 260 via coupler 630. Coupler aperture 673A of shroud 260 receives the upper portion of coupler 630.

A preferably circular shaped preferred support plate 604 positioned below auxiliary fan motor 116 is threadably engaged with hollow shaft 112 and secured thereto via preferred nut 645. Support plate 604 preferably has mounted on preferred side 604A a remote control receiver unit 610 and supports the adaptation of optional light module 28 on preferred side 604B. Preferably mounted between remote control receiver unit 610 and support plate 604 is preferred insulative barrier 285, wherein insulative barrier 285 serves to protect remote control receiver unit 610 from heat produced by optional light module 28. Remote control receiver unit 610 preferably controls the operation of heating module 16, auxiliary fan module 22 and optional lamp assembly 28 pursuant to manual or automatic signal outputs from a transmitter control unit 247 and received by remote control receiver unit 610. Remote control receiver unit 610 further preferably controls the number of heating elements 100 (i.e., 222A–222D) that are activated—any one or all of heating elements 222A–222D can be activated in any order desired.

Optional lamp assembly 28 is preferably conventionally attached to side 604B via a preferred base 130 having preferably apertures 132A and 132B for penetrably receiving screws or the like (not shown) that extend through support plate 604. A preferred central aperture 132C further allows routing of electrical conductors 50 to lamps 136 (not shown) One or more optional lamps 136 (not shown) are mounted on base 130. An optional transparent or translucent cover 138 is removably attached to base 130 to shield optional lamps 136 and permit transmission of light therethrough.

For powering of the various electrical components of device 10, electrical conductors 50 are channeled through the entirety of device 10. Electrical conductors 50 are preferably electrically connected to a source of power within the ceiling and channeled first through passage 612E of cover 612. Electrical conductors 50 are then routed through dress ring 613, through boss aperture 181 of upper support plate 600, along the inner surface of upper support plate 600, down along the inner surface of inlet ring 601, along the outer surface of heat shields 800 and 820, through throughholes 621A–621C of lower support plate 620, through coupler aperture 673A of shroud 260, through aperture 264 of shroud 260, through coupler 630 and into hollow shaft 112, through hole 112A in shaft 112 and connected first to remote control receiver unit 610, then back up through throughholes 621A–621C to motor 88 and auxiliary fan motor 116 and then to heating elements 100, and finally to optional lamp assembly 28.

Figure 4:
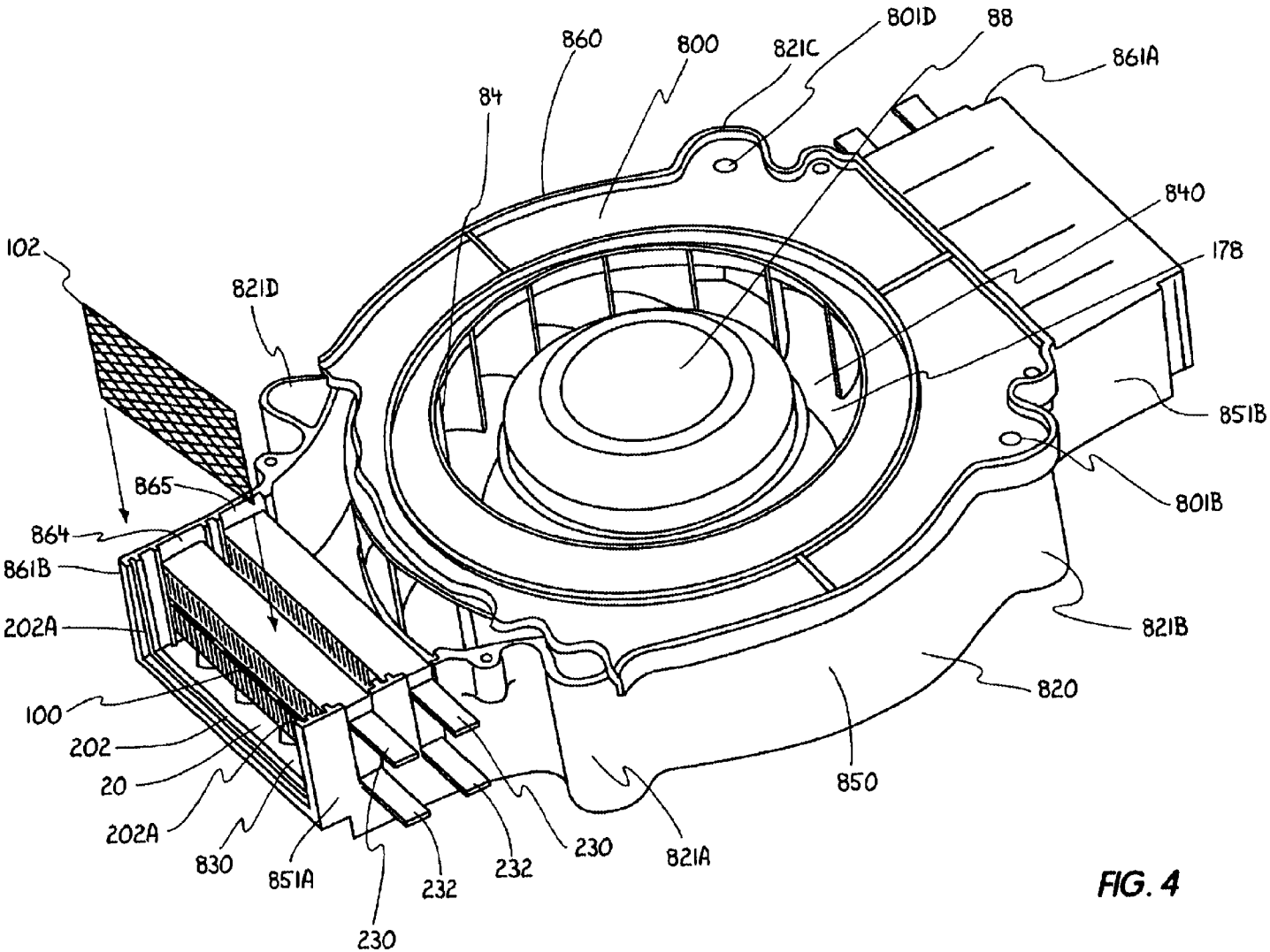
FIG. 4 is a perspective view of the impeller, motor and heat shields of an air recirculating and heating device according to a preferred embodiment of the present invention.

Referring now to FIG. 4, there is illustrated a further amplification and cutaway of lower heat shield 820, upper heat shield 800 and impeller 84 and motor 88 combination. It is the purpose of motor 88 and impeller 84 combination to draw air into circular opening 178 and create primary airflow 32 that exits along the outside radius of impeller 84. FIG. 4 depicts the unique preferred tandem or juxtaposed configuration of heating elements 100, wherein heating elements 100 are preferably Positive Thermal Coefficient Ceramic Heating Elements. It is this novel and preferred configuration that allows device 10 to achieve an enhanced flow rate at a higher exit temperature using lower energy settings than in previous configurations. By transferring a more robust heated air stream over fan blades 24, the heated airspace achieves higher temperatures at a faster rate of change. Heat shields 800 and 820 are preferably made of a heat sink plastic that inhibits the conductive transfer of heat, generated by heating elements 100, from impacting the reliability of motor 88 or auxiliary fan motor 116. Further, lower heat shield 820 and upper heat shield 800 combination form an enclosure around impeller 84 to ensure the proper channeling of airflow away from impeller 84, through heating elements 100 and through outlets 20 where airflow is exhausted as primary heated airflow 35. Heating elements 100 are preferably aligned in a preferred tandem arrangement to enhance the efficiency of primary heated airflow 35.

Figure 5:
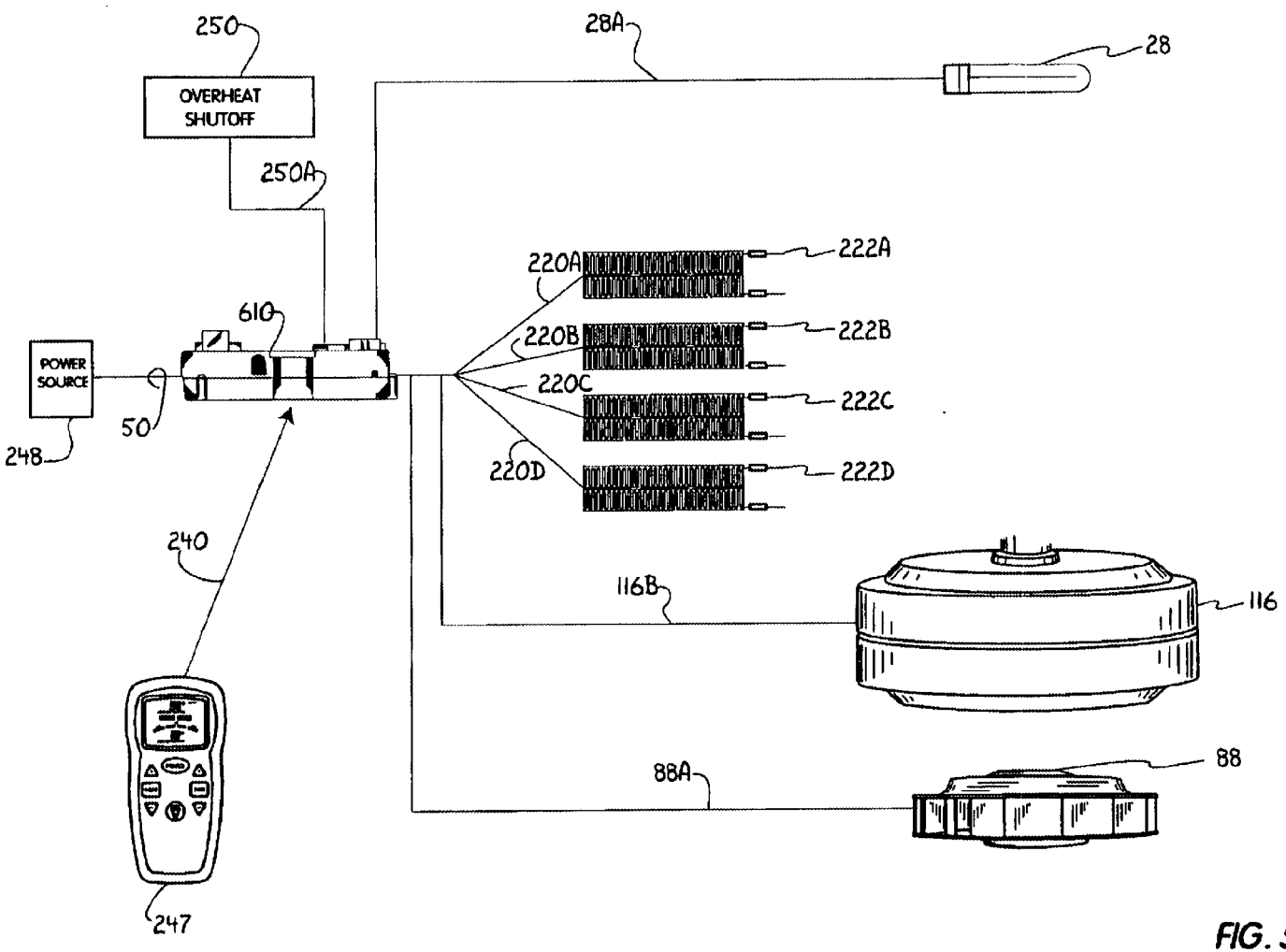
FIG. 5 is a schematic diagram of the preferred control circuitry for the present invention.

Referring now to FIG. 5, a schematic diagram of a preferred apparatus for controlling operation of device 10 is illustrated. It should be noted that both remote control receiver unit 610 and preferred transmitter 247 are commercially derived units that rely on digital readouts and computerization for size. New instructions for regulating heating elements 100 should be programmed into remote control receiver unit 610 and transmitter 247 for operation of device 10. Contained within the functions of transmitter 247 and remote control receiver unit 610 are device 10 activation and deactivation switches, switches for activating a desired number of heating elements 100, switches for activating auxiliary fan motor 116 and optional lamp assembly 28, as well as a digital display to indicate the chosen function, switches to increase or decrease desired temperature when in the heating mode, digital monitoring of both desired and actual temperature when in the heating mode, digital monitoring of the number of heating elements 100 activated when in the heating mode and switches to increase or decrease fan speed when in the fan mode.

There are various ways to regulate the amount of heat generated by a heating device. Among them, but not limited to, are analog switches, pull chains, buttons, timers, thermostats, remote control devices, their equivalence or any known means. It should be construed that the preferred manual or automatic remote control devices with their associated remote control receiver unit 610 could be, in alternate embodiments, any or all of the possible ways to regulate, as listed above, and are within the scope of the invention. A remote control receiver unit 610 preferably receives control signals 240 from transmitter 247. It is to be understood that the functions to be described of transmitter 247 may be incorporated into either a single unit or multitude of units. A source of power 248, such as conventional 120/220-volt alternating current available in all dwellings and office buildings, provides power via conductors 50 to remote control receiver unit 610; or, in an alternate embodiment, remote control receiver unit 610 may be battery or solar operated. Transmitter 247 may be battery powered or hard wired to a source of conventional 120/220-volt alternating current. Remote control receiver unit 610, on command, energizes one or more of heating elements 222 (A, B, C and/or D) via preferred conductors 220 (A, B, C and/or D, respectively) under command of transmitter 247. Along with energization of one or more of heating elements 222A–222D, motor 88 and impeller 84 are energized via preferred conductor 88A to cause a primary airflow 32 to move past heating elements 222A–222D and exhaust from heating module 16 as primary heated airflow 35. To distribute primary heated airflow 35 throughout a room, auxiliary fan motor 116 is energized via preferred conductor 116B to cause attached fan blades 24 to provide an upward secondary airflow 34 for mixing with primary heated airflow 35, resulting in the subsequent distribution of a mixture of airflows 36 throughout the room in which heating is desired. If attached, optional lamp assembly 28 can also be energized via preferred conductor 28A by transmitter 247 through remote control receiver unit 610. For safety reasons, a preferred overheat shut-off module 250 may be connected via preferred conductor 250A through remote control receiver unit 610 and cause de-energization of heating elements 222A–222D upon the occurrence of an overheat condition.

Figure 6:
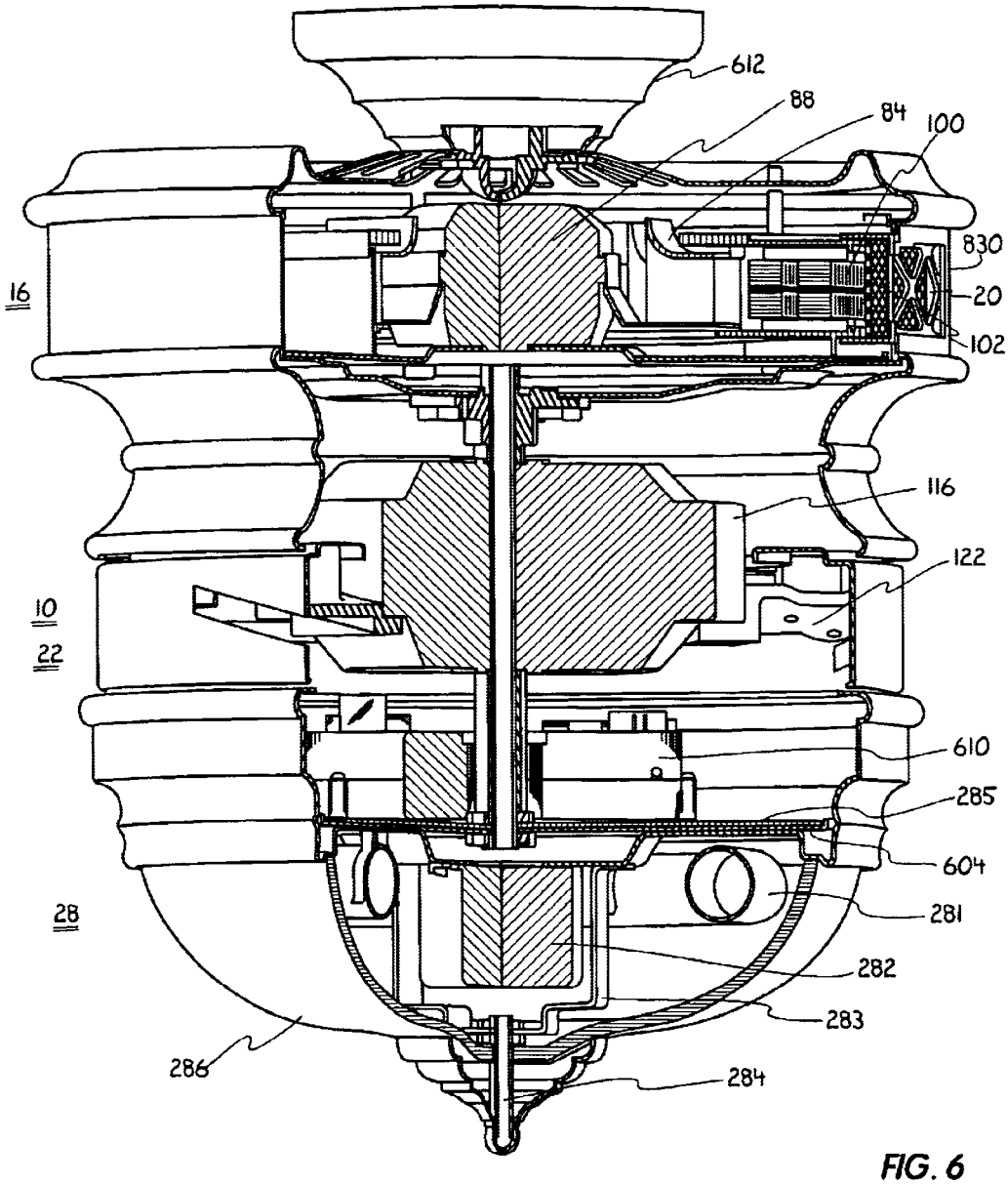
FIG. 6 is a partial cross-sectional view of an air recirculating and heating device according to a preferred embodiment of the present invention.

Referring to FIG. 6, device 10 is shown in the assembled version, depicting the modularity and relative locations of heating module 16, auxiliary fan module 22 and optional light module 28. Each module acts in an integrated fashion to first produce a heated air stream from heating module 16 with a flow of air created by impeller 84 rotated by primary motor 88 and heated by heating elements 100 before being exhausted through outlets 20. The resulting primary heated airflow 35 in turn mixes with upward secondary airflow 34 produced by auxiliary fan module 22 created by the rotation of auxiliary fan motor 116 supporting brackets 122 which in turn support fan blades 24 that create the actual upward secondary airflow 34 that when mixed with primary heated airflow 35 becomes heated and is distributed throughout the room. Preferably located downward of auxiliary fan motor 116 is remote control receiver unit 610 which controls the electrical components of device 10. Shown in this embodiment is a commercially available preferred fluorescent light kit 281 with associated ballast resistor 282. Optional lamp assembly 28 is in general conventionally attached to plate 604, wherein plate 604 supports a preferred bracket 283. Bracket 283 preferably supports a conventional mounting assembly 284 to support decorative globe 286 of optional lamp assembly 28. Preferably mounted upward of plate 604 is a preferred insulative barrier 285 to reduce the transfer of heat from optional light module 28 to remote control receiver unit 610.

Referring now to FIGS. 7A through 10B, there is illustrated the operation of preferred transmitter 247 and the resulting effect on heating module 16 and its main components, motorized impeller 84 and heating elements 222A, 222B, 222C and 222D, to create a primary heated airflow 35. As depicted, preferred transmitter 247 includes options for power-on or power-off of device 10; monitoring and selecting heat or fan settings; monitoring and setting desired temperature; monitoring actual room temperature; adjusting fan speed; adjusting illumination of optional light module 28 and monitoring the number of heating elements 100 currently in use. If the room is to be heated, the power button on preferred transmitter 247 is depressed and the digital display is actuated. The heat button is then depressed highlighting the word heat on the digital display and activating the heating module. The desired temperature is then set with the + and – buttons above and below the heat button, wherein depression of the + and – buttons changes the desired temperature digital display. Heating module 16 then automatically activates preferably motorized impeller 84, one or more of heating elements 222A, 222B, 222C and 222D depending on the temperature range between desired and actual temperature and auxiliary fan module 22 to rotate in the upward direction. If only the fan is required for cooling, the fan button is depressed, causing the word "fan" to become highlighted on the digital display and auxiliary fan module 22 to rotate fan blades 24 in the downward direction. The speed of fan rotation is adjusted with the + or – buttons above and below the fan button. Upon initial startup, in the heat mode, and assuming that the desired temperature is at least three degrees higher than the actual temperature, preferred transmitter 247 will activate all heating elements 222A–222D in order to quickly narrow the gap between actual room temperature and desired room temperature. As the gap narrows heating elements 222A–222D will be automatically deactivated until only the minimum required to maintain the desired temperature are producing heat. It is to be noted that any computer algorithm may be applied to preferred transmitter 247 and preferred remote control receiver unit 610 combination to activate the timing of heating element 100 activation or deactivation. Any or all of those algorithms must be considered within the scope of the present invention.

Figure 7B:
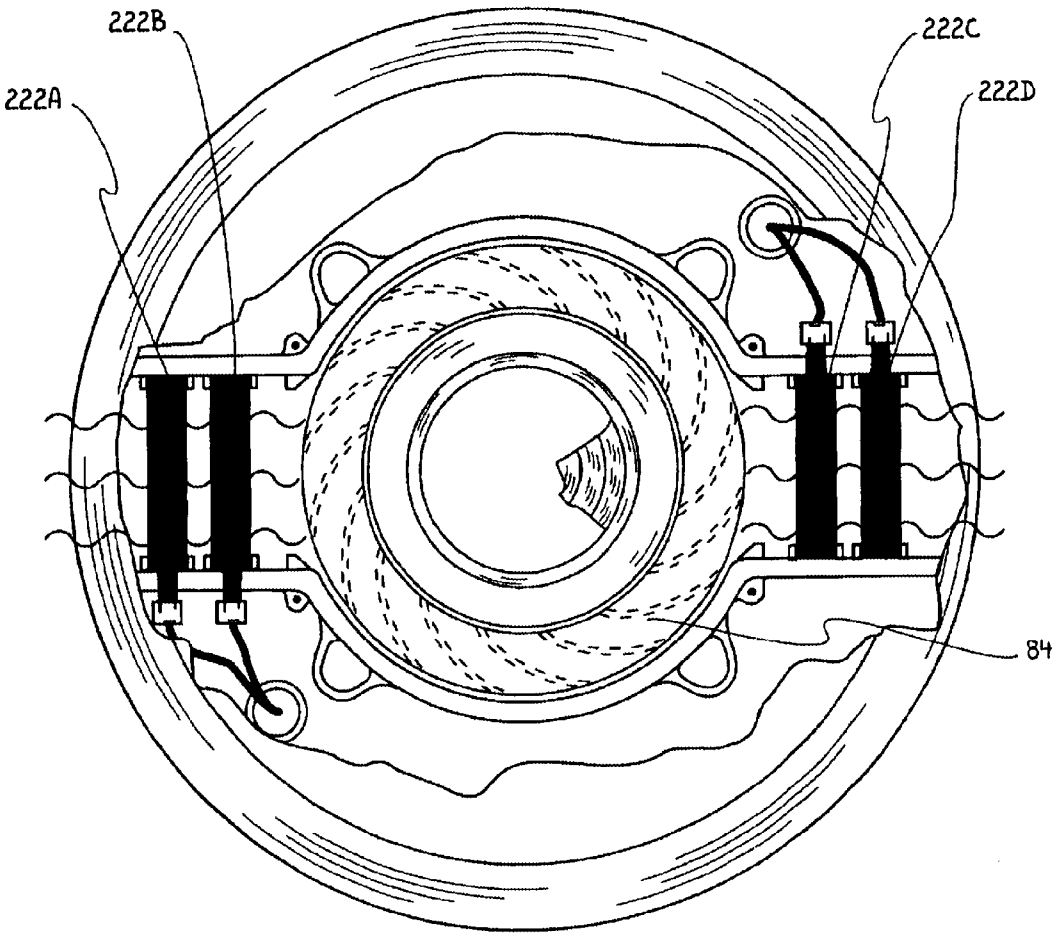
FIGS. 7A and 7B illustrate the preferred control unit and the corresponding actuated preferred heating elements.
Figure 7A:
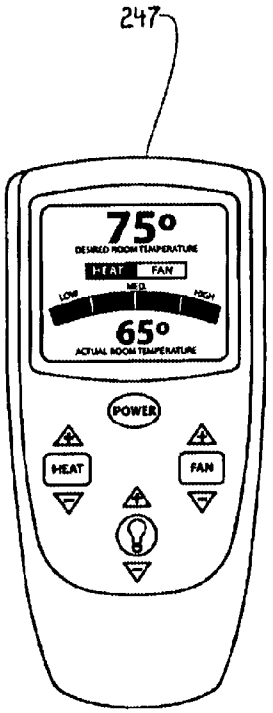
Figure 8B:
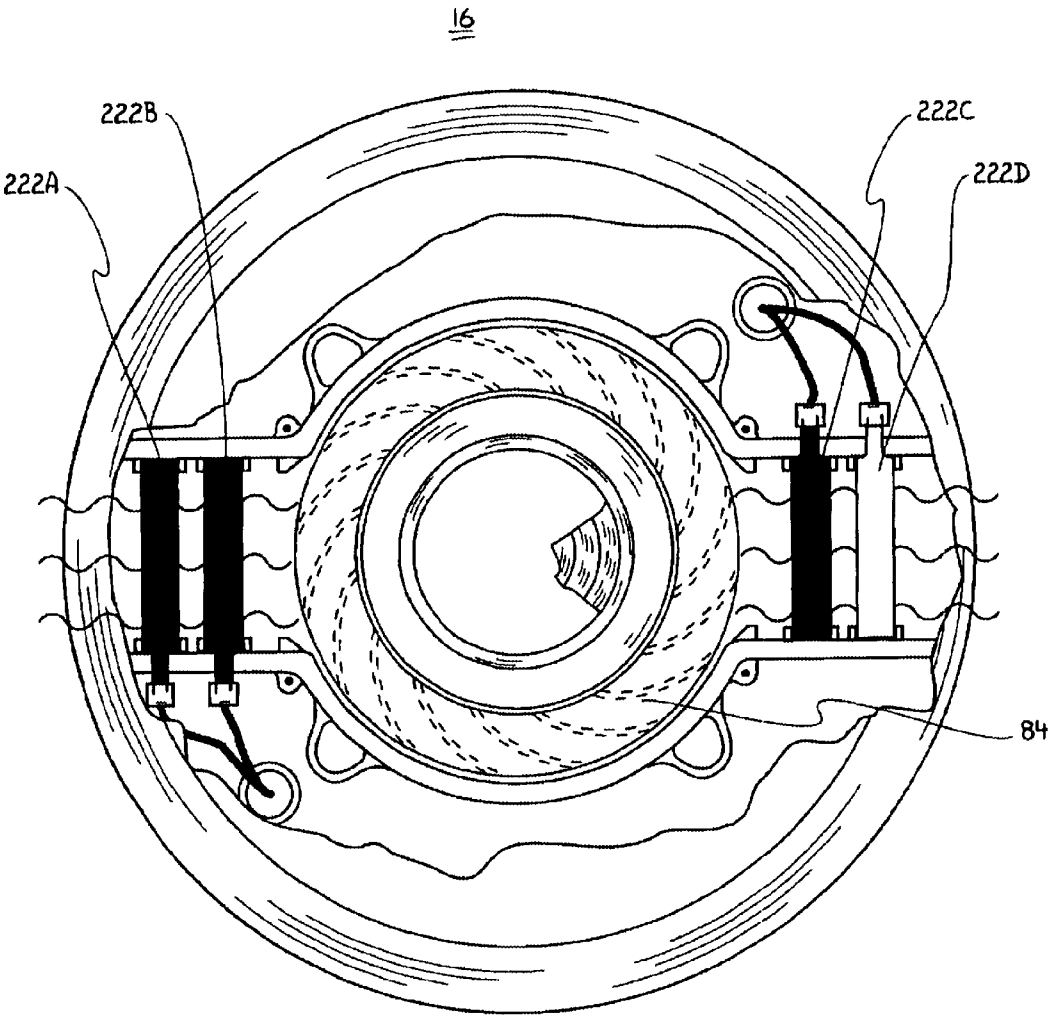
FIGS. 8A and 8B illustrate the preferred control unit and the corresponding actuated preferred heating elements.
Figure 8A:
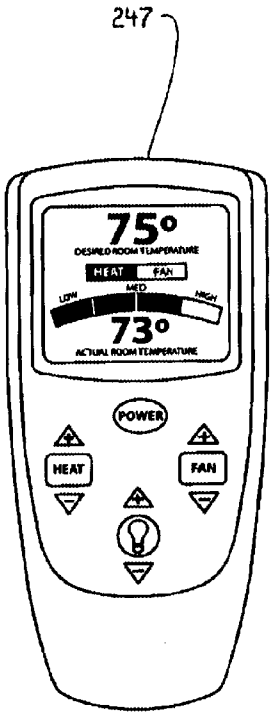
Figure 9B:
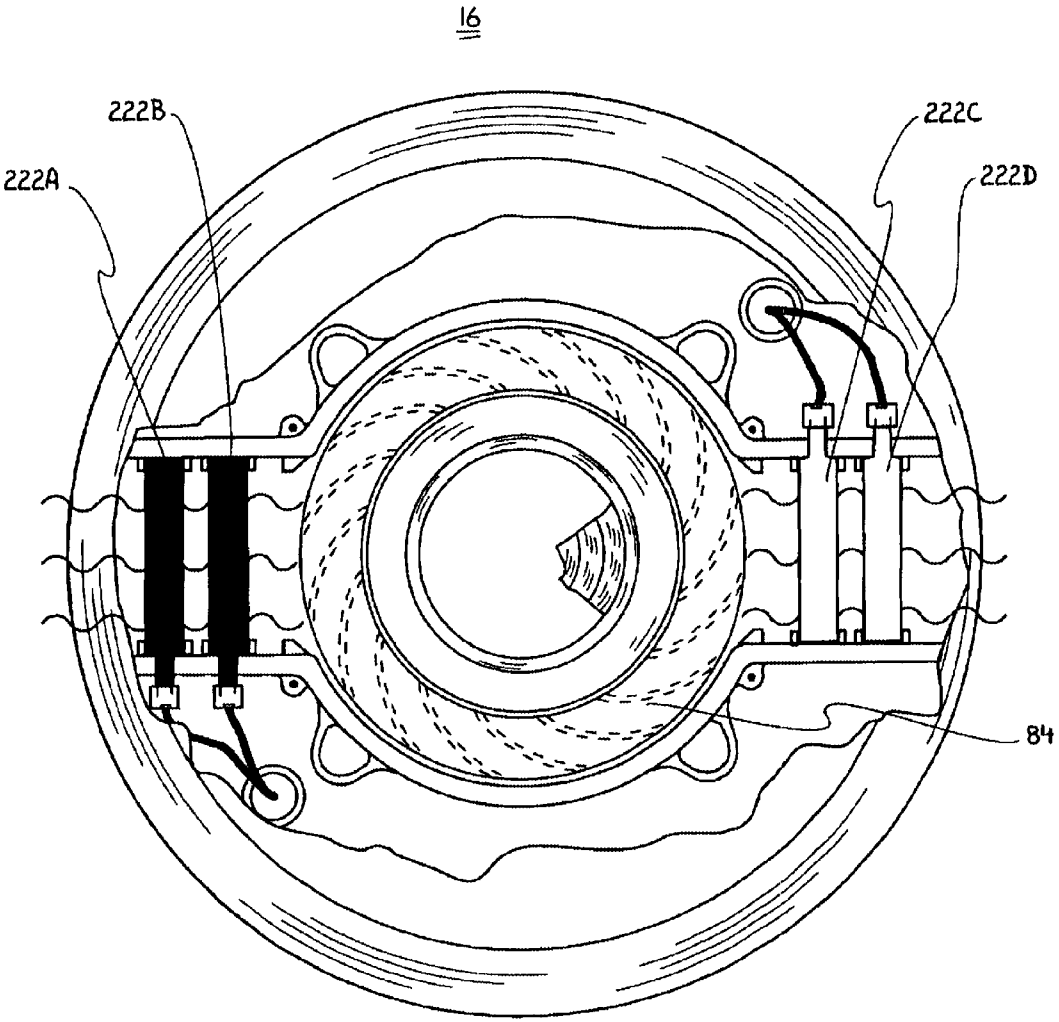
FIGS. 9A and 9B illustrate the preferred control unit and the corresponding actuated preferred heating elements.
Figure 9A:
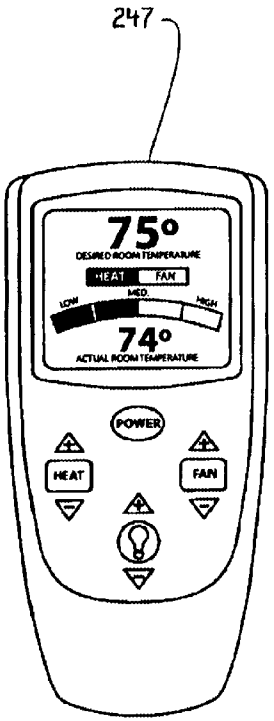
Figure 10B:
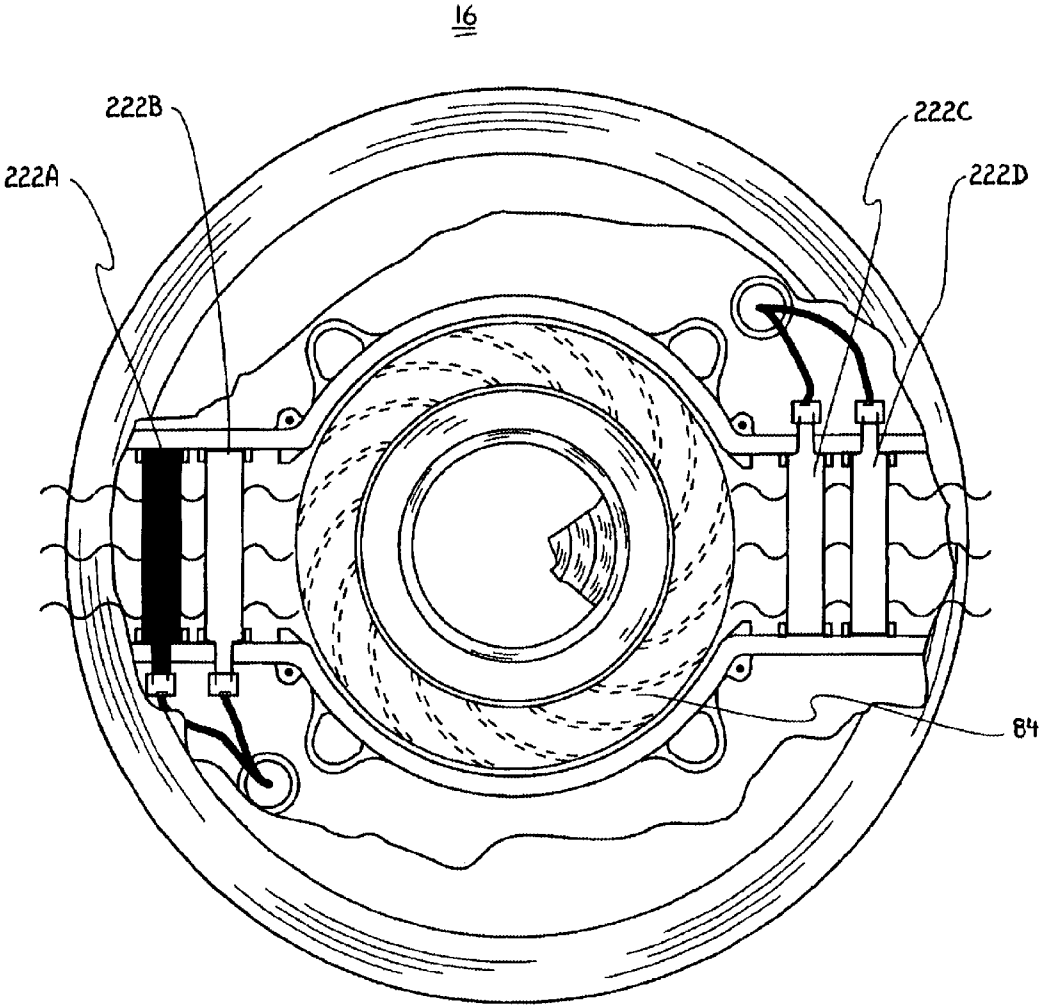
FIGS. 10A and 10B illustrate the preferred control unit and the corresponding actuated preferred heating elements.
Figure 10A:
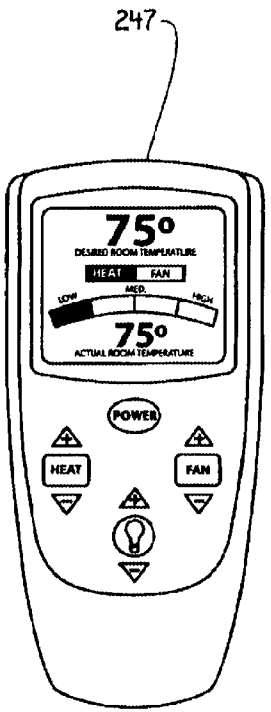

As illustrated in FIGS. 7A and 7B, desired temperature 75 degrees and actual room temperature are separated by 10 degrees causing all heating elements 222A–222D to be activated for increasing the room temperature. As illustrated in FIGS. 8A and 8B, when the desired temperature and actual temperature as indicated on preferred transmitter 247 near, heating elements 222A–222D will start to deactivate in order to maintain the desire room temperature. FIGS. 8A and 8B illustrate the condition where only three heating elements 222A, 222B and 222C are activated. FIGS. 9A and 9B illustrate a condition where only two heating elements 222A and 222B are activated, and FIGS. 10A and 10B illustrate the ultimate condition where only heating element 222A is activated to maintain the desired temperature. Should the actual temperature drop due to a decrease in outside air temperature, an open door or open window, transmitter 247 will command the reactivation of heating elements 222B, 222C or 222D to maintain the desired room temperature. It is this preferred function that enables air recirculating and heating device 10 to efficiently use electrical energy to heat a room.

Figure 11:
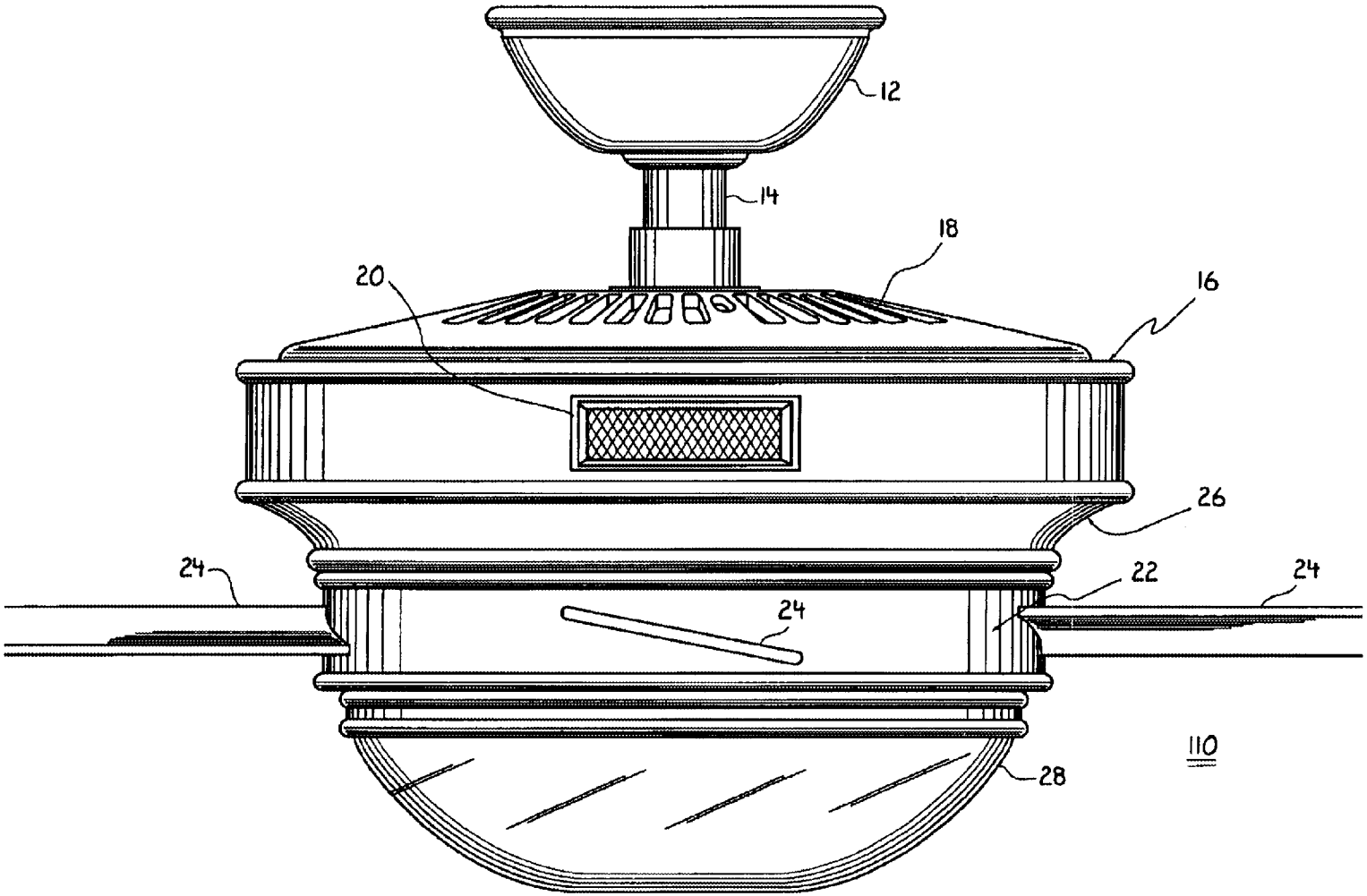
FIG. 11 is a side view of an air recirculating and heating device according to an alternate embodiment of the present invention showing the device housed within one of several optional decorative housings.

Referring now to FIG. 11, there is illustrated an air recirculating and heating device 110 according to an alternate embodiment of the present invention, showing device 10 enclosed within optional decorative elements or housings. It is to be understood that the exterior configuration illustrated is simply one of a multitude of decorative exterior configurations that may be utilized. Device 110 is adapted from an upward location within a room, such as the ceiling of the room, wherein a cover 12 may be optionally incorporated to shield the supporting and attachment mechanisms. A shaft 14 extends downwardly to perform the adaptive function for device 110 and to convey therewithin the requisite electrical conductors 50. Although one shaft 14 is shown, a plurality of shafts may be utilized. Various mechanisms can be utilized to adapt device 110 to an upward location such as, for exemplary purposes only, shafts, rods, chains, ropes, cables, brackets or the like or an known means or combination thereof. Shaft 14 is a hollow shaft (sometimes called a downrod); its use throughout this specification should be construed that any or all of the possible mechanisms, described above, and all equivalence thereof, are within the scope of the invention. A heating module 16 includes one or more outlets 20 disposed thereabout. Outlets 20 provide a primary airflow path for heated air as a function of the amount of heating to be performed. An auxiliary fan module 22 comprises an auxiliary fan motor 116 for rotating fan blades 24 to produce a secondary airflow, wherein secondary airflow may be upward during a heating phase or downward during a cooling phase. An optional decorative shroud 26 may interconnect heating module 16 with auxiliary fan module 22. An optional light module 28 may be adapted to the auxiliary fan module 22.

Figure 12:
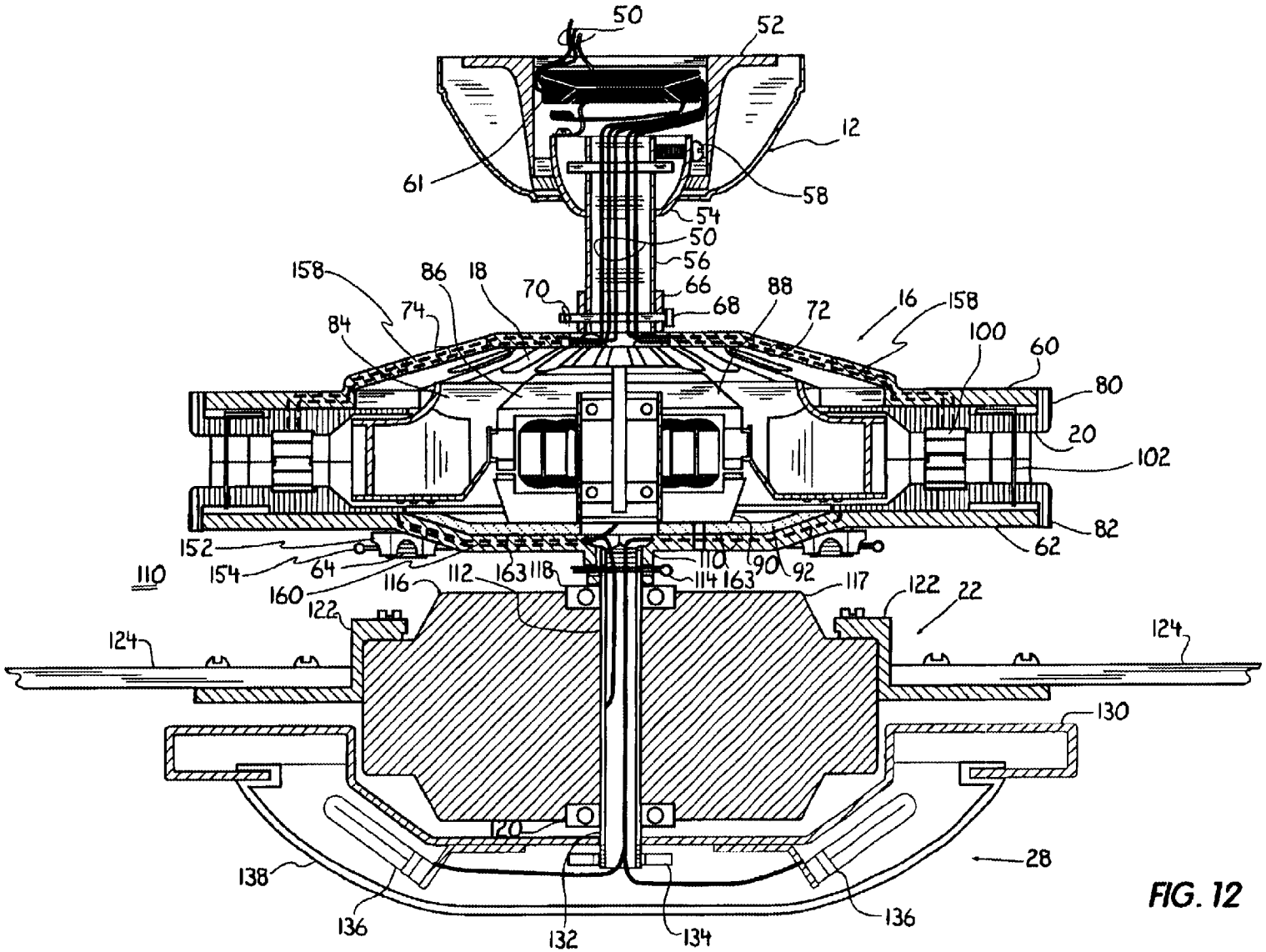
FIG. 12 is a cross-sectional view of an air recirculating and heating device according to an alternate embodiment of the present invention showing the salient elements of the device.

Referring now to FIG. 12, there is illustrated a support means housed within optional cover 12, and cross sectional views of heating module 16, auxiliary fan module 22 and optional lamp assembly 28. It is to be noted that optional decorative housings for these units have been omitted for purposes of clarity. The optional decorative shroud 26 between heating module 16 and auxiliary fan module 22 shown in FIG. 11 has further been omitted. A plurality of electrical conductors 50 are electrically connected to a source of electric power to provide power for the various electrical components of device 110. A bracket 52 is attached to a joist in the ceiling or similar support member, wherein a cup shaped receiver 54 is supported by bracket 52 and secures hollow shaft 56 in place by use of set screw 58 or the like.

Remote control receiver unit 61 is mounted within optional cover 12 or optional decorative shroud 26 to receive signals from a transmitter control unit 244 or 246. Remote control receiver unit 61 controls the operation of heating module 16, auxiliary fan module 22 and optional lamp assembly 28 pursuant to manual or automatic signal outputs from transmitter control unit 244 or 246 and received by remote control receiver unit 61. Electrical conductors 50 are channeled through shaft 56 for electrical connection with the respective electrical components. Heating module 16 includes upper support plate 60 and lower support plate 62 secured to one another by a plurality of pins 64, as more fully described below. There are various methods and designs for securing upper and lower support plates 60 and 62 such as, for exemplary purposes only, pins, bolts, studs, clamps, wires, shafts, rods, adhesive, screws, brackets or any other known means. For pin 64, as used throughout this specification, it shall be construed that any or all of the possible methods or devices, described above, or their equivalence are within the scope of the invention. Additionally, there are various methods and devices for securing pins 64, such as, for exemplary purposes only, castle nuts, nylock, cotter pins, chemical bonding, spring retention, or any other known means. Nut 152 and cotter pin 154 combination, as used throughout this specification shall be construed such that any or all of the possible methods or devices, described above, or their equivalence are within the scope of the invention.

Support plate 60 includes a boss 66 extending upwardly therefrom for receiving the lower end of shaft 56. A pin 68 penetrably engages boss 66 and shaft 56 to secure them to one another, and a cotter pin 70 prevents withdrawal of pin 68. Support plate 60 may include a plurality of channels 158 formed therein for receiving conductors 72 and conductors 74, wherein conductors 72 and 74 provide electric power to various components.

A heat barrier, formed from heat insulative material such as high temperature plastic, ceramic or any other known thermally nonconductive material and hereinafter referred to as a heat shield 80 and heat shield 82, is utilized to prevent heat transfer from heating elements 100, 222, as described below, to support plates 60 and 62 and through conduction to motor 88 components or auxiliary fan module 22. Alternatively, any known heat-sink material may be utilized as a heat barrier such that heat is directed away from the components. An impeller 84 is mounted upon a rotor 86 of a conventional electric motor 88. Impeller 84 draws air through inlets 18 in support plate 60 and exhausts the air laterally through outlets 20 proximal to heat shields 80 and 82. A stator 90 of electric motor 88 is mounted upon a disk 92 located centrally of support plate 62. Disc 92 may be made of a heat resistant material to further protect motor 88 from additional heat. In a further embodiment disc 92, preventive in nature, may be omitted in its entirety. Each of one or more of heating elements 100 is mounted at selected locations intermediate heat shields 80 and 82. A screen 102 downstream of each heating element 100 is also mounted between heat shields 80 and 82 to prevent contact with a respective heating element 100, to prevent injury and for decorative purposes. Necessarily, screen 102 is perforated to permit airflow, induced by impeller 84, therethrough. A hollow boss 110 extends downwardly from the center of support plate 62. A hollow shaft 112 is adapted within boss 110 and is retained by a threaded interface. Alternatively, a cotter pin 114 or a solid pin, such as pin 68 retained in place by its own cotter pin, may be utilized. A conventional auxiliary fan motor assembly, hereinafter referred to as auxiliary fan motor 116 includes a rotor 117 rotatably secured to shaft 112 through bearings 118 and 120. Stator 90 (not shown) of auxiliary fan motor 116 is attached to shaft 112. Each of a plurality of brackets 122 is attached to rotor 117 and supports one or more fan blades 124.

Optional lamp assembly 28 includes a base 130 having a central aperture 132 for penetrably receiving the lower end of shaft 112. A nut 134 is in threaded engagement with the lower end of shaft 112 to retain base 130 fixably attached to shaft 112. One or more optional lamps 136 are mounted on base 130. An optional transparent or translucent cover 138 is removably attached to base 130 to shield optional lamps 136 and permit transmission of light therethrough.

Electrical power for auxiliary fan motor 116 and lamp assembly 28 is routed through channels 158 and 160 within support plates 60 and 62, respectively, of heating module 16 and thereafter through shaft 112. Specifically, electrical conductors 72 and 74 and electrical conductors 162 and 163 are housed within channels 158 and 160, respectively, and are thus protected and shielded from abuse and tampering.

From the above discussion pertinent to FIG. 12, several features may be emphasized. First, the use of a common shaft 112 to support both heating module 16 and auxiliary fan motor 116 has been omitted. Second, heating module 16 includes a support structure formed by upper and lower support plates 60 and 62, respectively, and upper and lower heat shields 80 and 82, respectively, extending about an essentially enclosed impeller 84, of sufficient strength and robustness to adapt auxiliary fan module 22. Third, the configuration and size of each of the modules may be altered to conform to the specific space and power requirements without departing from the design philosophy attendant the air recirculating and heating device 110 described herein.

Figure 13:
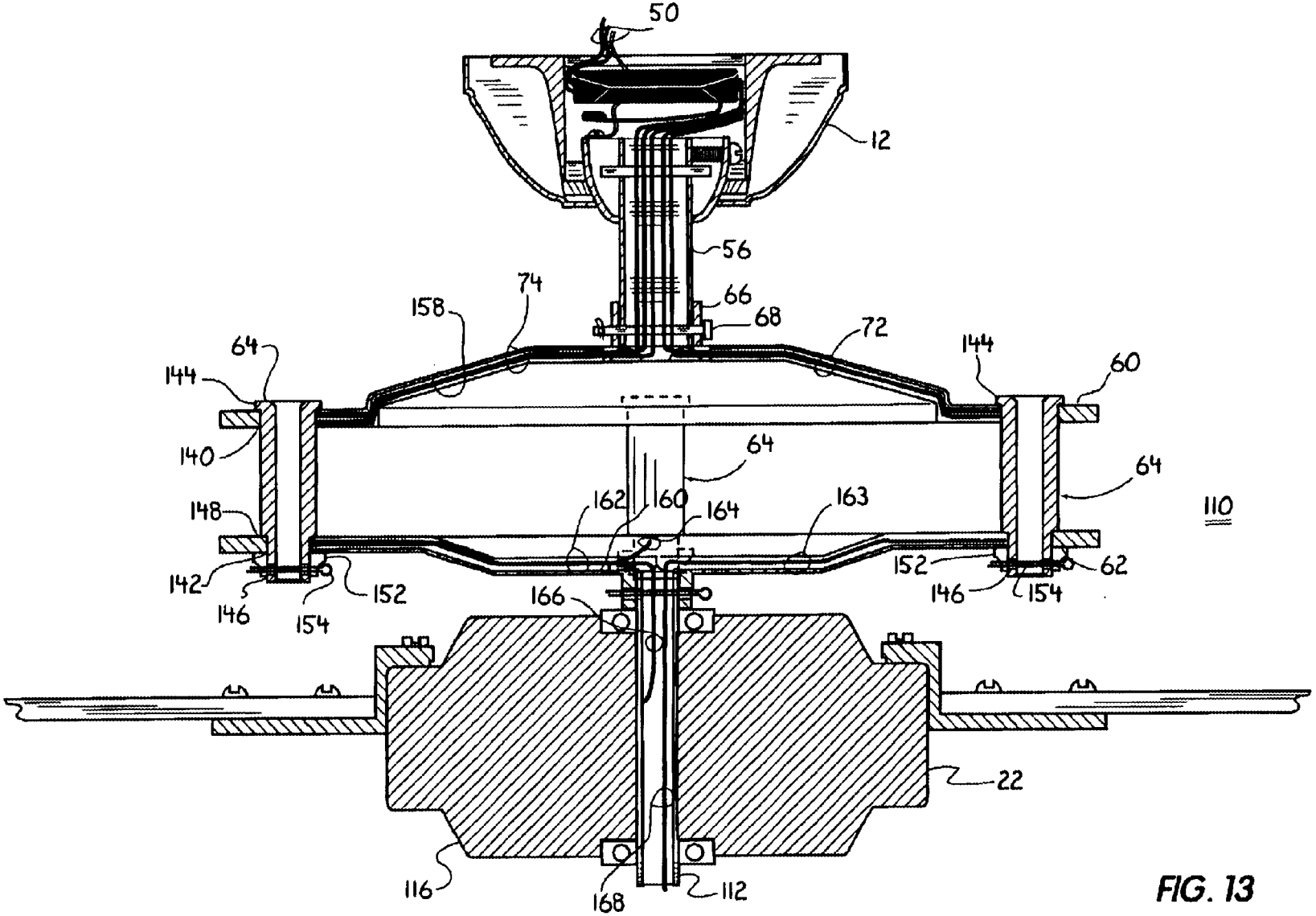
FIG. 13 is a cross-sectional view of an air recirculating and heating device according to an alternate embodiment of the present invention showing wiring of the electrical conductors.

Referring specifically now to FIG. 13, further details attendant device 110 will be described. Each of plurality of pins 64, such as four (4) pins 64, equiangularly spaced about support plates 60 and 62, penetrably engage aperture 140 in support plate 60 and aperture 142 in support plate 62. Pins 64 may be hollow, as depicted, and may be used in one embodiment for channeling electrical conductors 72, 74, 162, 163 and 164 from channel 158 in support plate 60 to channel 160 in support plate 62. Each pin 64 includes a shoulder 144 bearing against the upper surface of support plate 60. Lower end 146 of pin 64 is necked down to provide a shoulder 148 seated on the upper surface of support plate 62. A castle nut 152 is in threaded engagement with lower end 146 to rigidly connect pin 64 with support plate 62. A cotter pin 154 may be used to prevent rotation of castle nut 152. From this description it will become apparent that support plate 62 is dependently supported from support plate 60 by plurality of pins 64. As discussed above, channels 158 and 160 may be formed in support plates 60 and 62, respectively, to receive a plurality of electrical conductors 72 and 74 and 162, 163, and 164, respectively, wherein conductor 164 may be used to provide electrical power to motor 88 for rotating impeller 84. A further set of conductors 166 extending into shaft 112 provides power to auxiliary fan motor 116. A further set of conductors 168 extending through shaft 112 and into optional lamp assembly 28 provides electrical power to lamps 136 within optional lamp assembly 28, wherein all conductors 72, 74, 162, 163, 164, 166 and 168 are in electrical communication with a power source.

Figure 14:
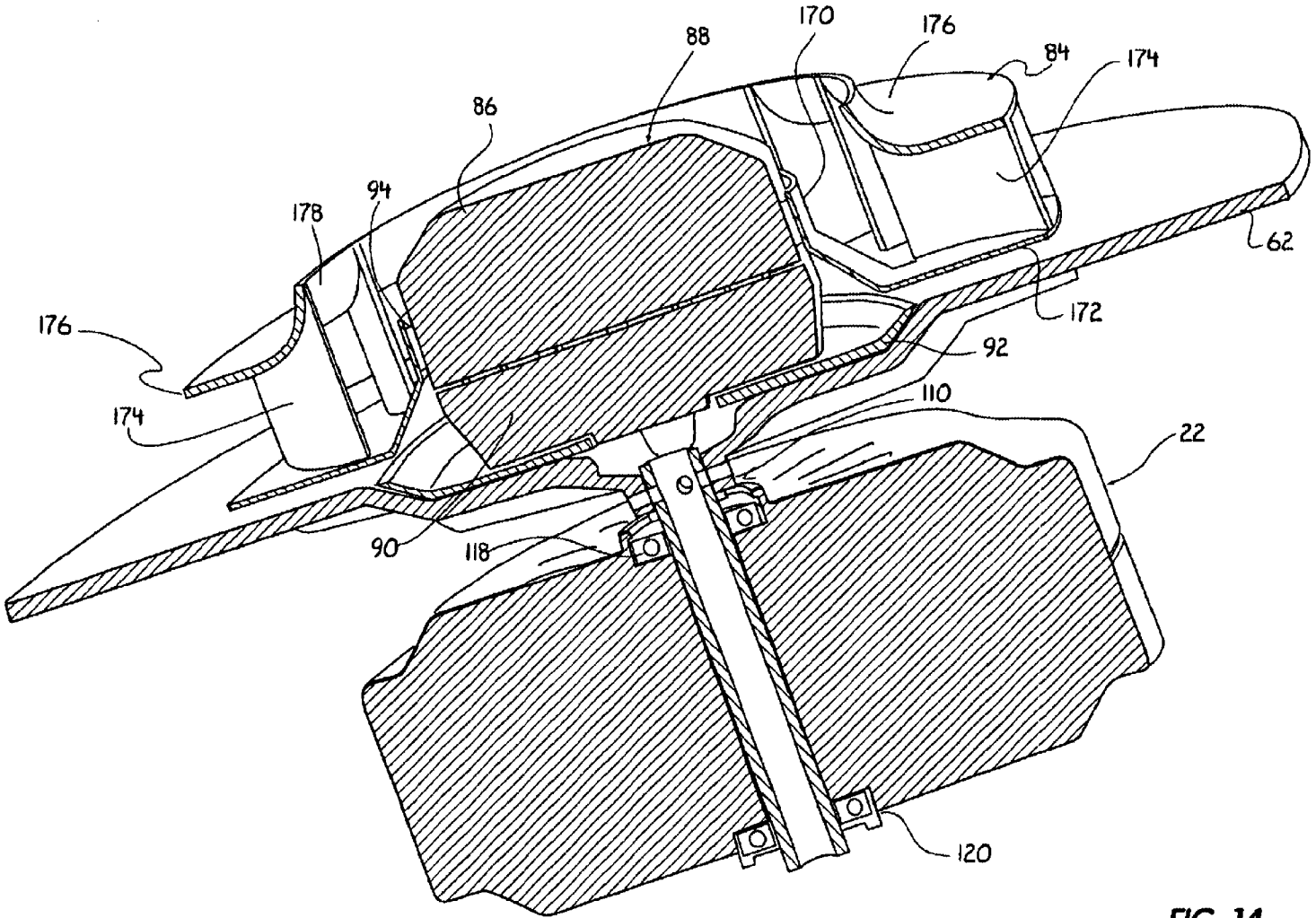
FIG. 14 is a partial cross-sectional view of an air recirculating and heating device according to an alternate embodiment of the present invention showing the motorized impeller and auxiliary motor.

FIG. 14 illustrates in further detail impeller 84 and its motor 88. It should be noted that there are various other configurations and combinations of fan and motor assemblies such as, for exemplary purposes only, brushless motors, motors with stators and rotors, squirrel cage, blower, impeller fans and any other known means or devices that may be utilized. It should be construed that impeller 84 with its stator 90 and rotor 86 configuration as described herein to create a primary airflow could be any or all of the possible configurations described above or their equivalence and remain within the scope of the present invention.

Stator 90 of motor 88 is mounted upon optional disk 92 secured to support plate 62. Rotor 86 includes a mounting 94 for attachment with a cylindrical segment of base 172 of impeller 84. A plurality of curved vanes 174 extend upwardly from base 172 and are attached to an upper member 176 defining a circular opening 178, wherein circular opening 178 serves as an air inlet for impeller 84. Vanes 174, base 172 and upper member 176 may be constructed as separate components of similar or dissimilar material or molded as a single unit of the same material. It is to be understood that motor 88 and impeller 84 are commercially available from appropriate sources.

Figure 15A:
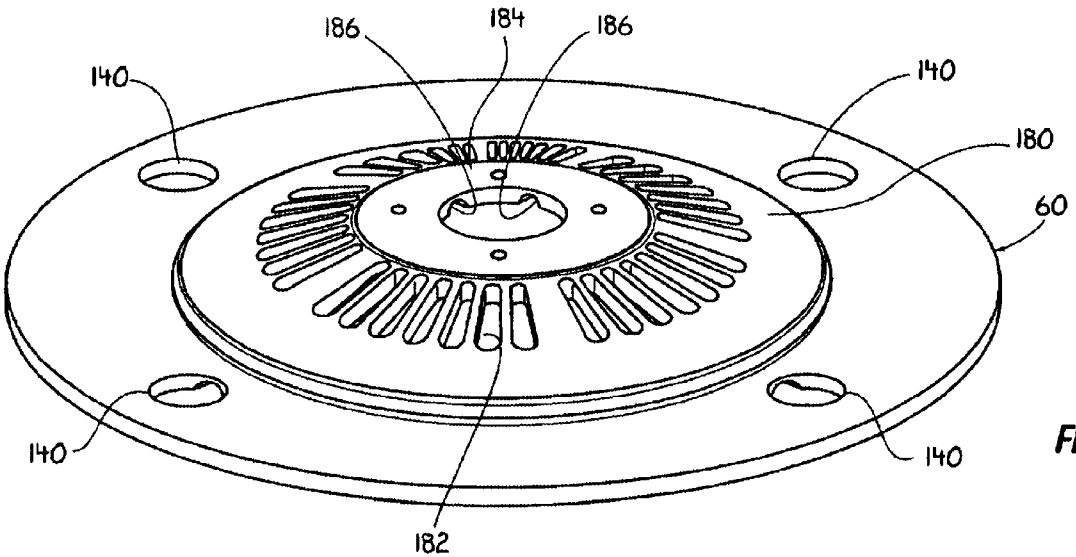
FIGS. 15A and 15B are perspective views of the support plates for an air recirculating and heating device according to an alternate embodiment of the present invention.
Figure 15B:
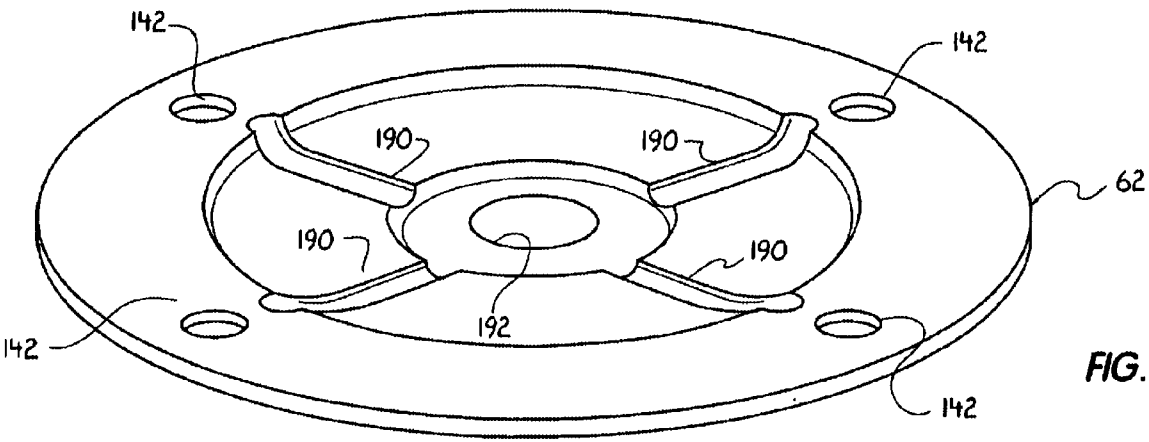

Referring now to FIGS. 15A and 15B, support plates 60 and 62 will be described in detail. It should be noted that the top and bottom of support plates 60 and 62 are designed to allow the ingress of air, the routing of electrical conductors 72, 74, 162, 163 and 164, and the support for heating elements 100, heat shields 80 and 82 and impeller 84. The design options of support plates 60 and 62 are endless and should not be limited to those shown in the attached Figures. Air is drawn through a plurality of inlets 18, wherein 42 of such inlets 18 are formed thereon; however, in alternate embodiments air can be drawn through any number or design of inlets, and wires can be routed in any direction or fashion. The design shown in the accompanying Figures represents a design that both accomplishes these requirements and enhances manufacturability, but any design that functionally meets these requirements are within the scope of the invention. Support plate 60 includes each of a plurality of apertures 140 for penetrably receiving one of pins 64 (see FIG. 13). A shallow central cone section 180 includes a plurality of radial slots 182 defining inlets 18 for introducing airflow therethrough and into impeller 84 via circular opening 178. A centrally located disk section 184 may support a radial flange from which boss 66 extends (see FIG. 12). A plurality of radially extending grooves 186 are formed on the inside surface of support plate 60 to receive the requisite electrical conductors 72 and 74. Support plate 62 includes a plurality of apertures 142 to receive and support lower end 146 of respective pins 64. A plurality of grooves 190 are formed in support plate 62 to convey electrical conductors 162 and 164 beneath disk 92 (see FIG. 12) and through aperture 192.

Figure 16:
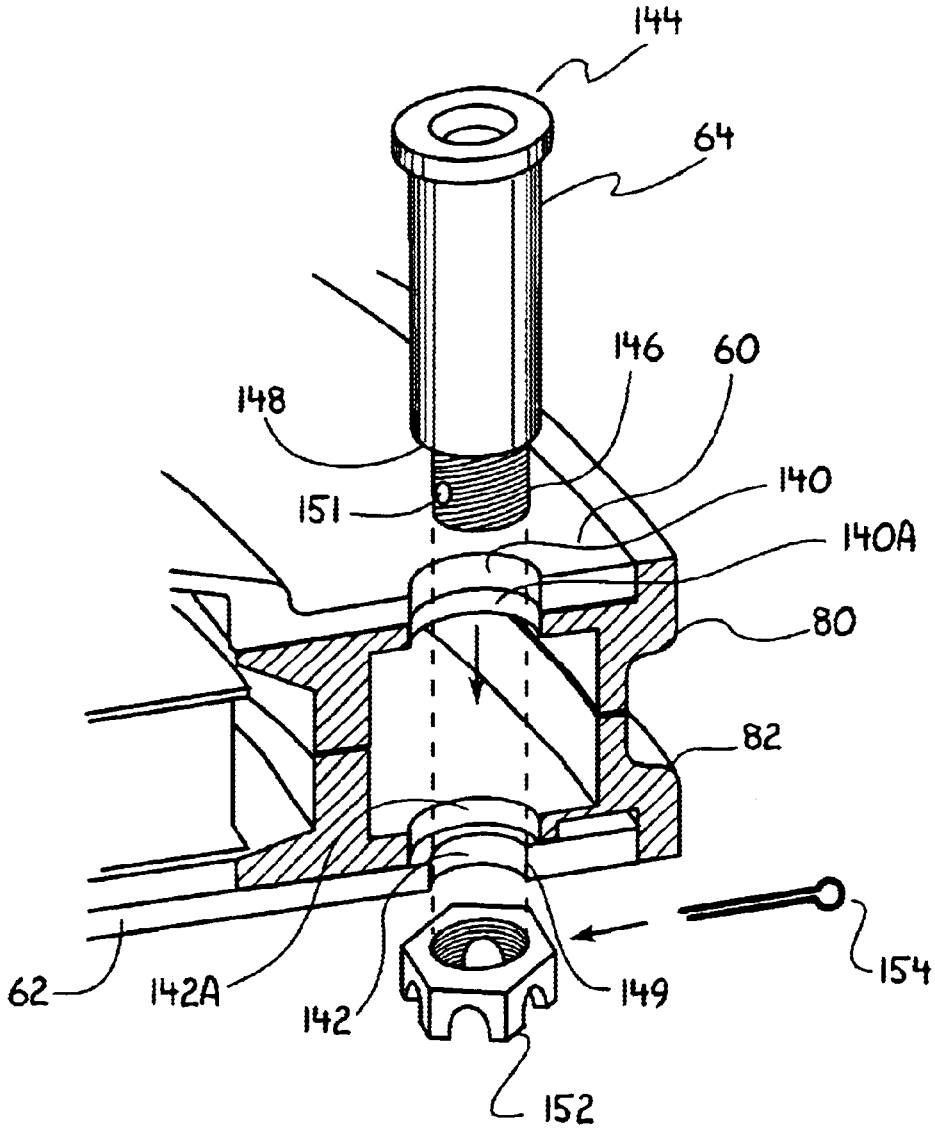
FIG. 16 is an exploded view of a pin for retaining the support plates of an air recirculating and heating device according to an alternate embodiment of the present invention.

Details of each of pins 64 will be described with particular reference to FIG. 16. Pin 64 extends through aperture 140 in support plate 60 and through aperture 140A in heat shield 80. Similarly, pin 64 extends through aperture 142A in heat shield 82 and aperture 142 in support plate 62. Shoulder 148 of pin 64 is supported by support plate 62. Castle nut 152 engages the threads of the necked down section of lower end 146 of pin 64. Cotter pin 154 penetrably engages castle nut 152 and passageway 151 in pin 64.

Figure 17D:
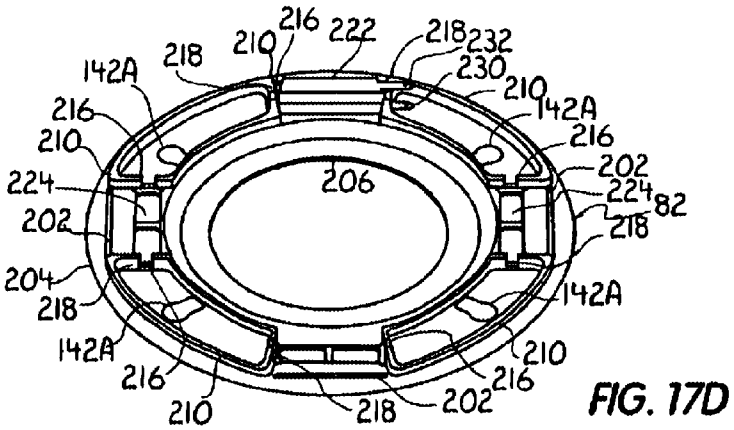
FIGS. 17A, 17B, 17C and 17D are perspective views of the heat shields of an air recirculating and heating device according to an alternate embodiment of the present invention.
Figure 17C:
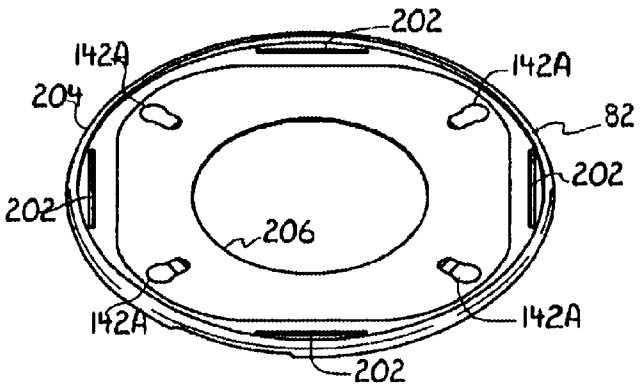
Figure 17A:
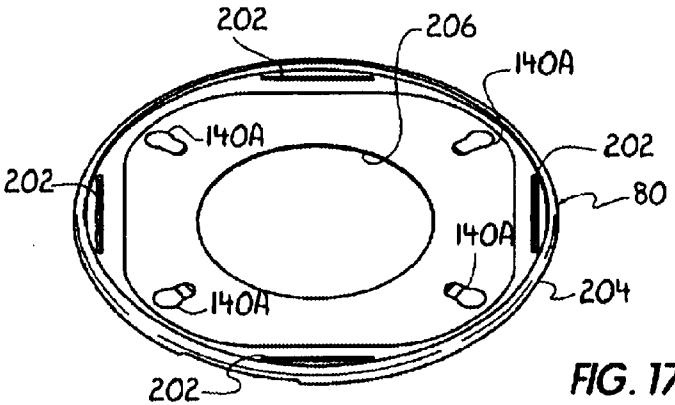
Figure 17B:
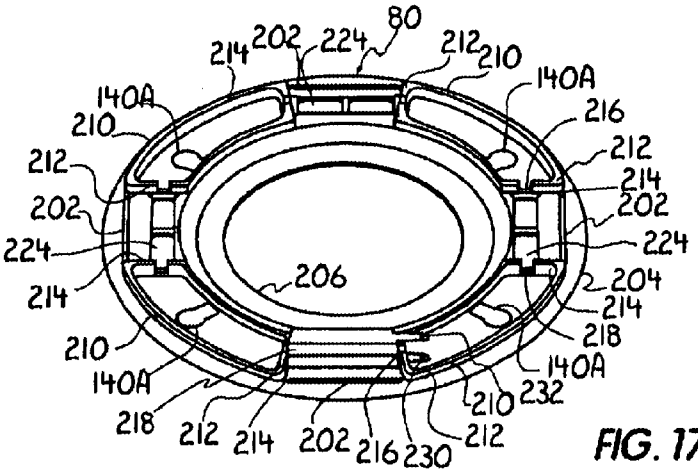

Referring jointly to FIGS. 17A, 17B, 17C and 17D, details attendant heat shields 80 and 82 will be described in detail. Heating module 16 as utilized in the design of device 110, further comprises heat shields 80 and 82, wherein heat shields 80 and 82 support heating elements 100 and protective screens 102. Although thermally insulative material, such as high temperature plastic or ceramic, is the material of choice for heat shields 80 and 82, there are various other methods and materials contemplated for isolating heating elements 100 from components of device 110 affected by adverse heat. Among them, but not limited to, are other thermally insulative materials, heat sink heat shield materials, reflective materials and distance from adjacent components and their equivalence. There are also various electric heating elements that may serve the same purpose. Among them, but not limited to, are PTC, ceramic, coiled wire or any other known method or materials including their equivalence. Denying consumer access, as a safety precaution, to heating elements 100 can be performed in various ways. Among them, but not limited to, are screens, bars, molded plastic, wire mesh or any other known methods or devices including their equivalence. It should be construed that the heat shields 80 and 82, heating elements 100 and screens 102 as used in this specification implies that any or all of the possible elements, listed above and their equivalence, are within the scope of the invention. FIG. 17A illustrates the top side of heat shield 80, wherein heat shield 80 has a plurality of apertures 140A for receiving a respective one of pins 64. A plurality of slots 202 are formed therein for penetrably mounting a respective one of screens 102 (see FIG. 12). A circumferential lip 204 extends about the perimeter for receiving the edge of support plate 60. A centrally positioned aperture 206 is formed to provide unimpeded airflow through slots 182 in support plate 60 (see FIG. 15A). The underside of heat shield 80 is shown in FIG. 17B, wherein a plurality of generally trapezoidal-shaped walls 210 are disposed generally centered upon apertures 140A and extend downwardly therefrom (it is to be noted that FIG. 17B illustrates the bottom side of heat shield 80). Wall sections 212 and 214 are generally radially aligned and include slots 216 and 218, respectively, formed therein. Slots 216 and 218 are provided to support tabs 230 and 232 extending from heating elements 100/222, of which one such heating element 222 is shown mounted in place.

FIGS. 17C and 17D illustrate the bottom and top surfaces, respectively, of heat shield 82. Heat shield 80 and 82 are identical to one another and common reference numerals have been used to identify corresponding elements.

Upon mounting heat shield 80 upon heat shield 82, apertures 140A and 142A and slots 202 of heat shields 80 and 82 will be vertically aligned with one another. Similarly, walls 210 will be aligned with one another in contacting relationship to provide an essentially closed airspace therewithin to prevent heat transfer to pins 64 extending through apertures 140A and 142A and to channel air created by preferably motorized impeller 84 through heating elements 100/222. Furthermore, heat shields 80 and 82 are formed from heat insulative material, and will serve as a heat barrier to reduce heat transfer from heating elements 100/222 to support plates 60 and 62 and other elements adjacent heat shield 80 and 82. The outflow of air through heating elements 100/222 induced by motorized impeller 84 will reduce heat flow radially inwardly from heating elements 222 to impeller 84 and its motor 88. Screens 102, mounted within slots 202, shield heating elements 222 against inadvertent or deliberate contact to prevent damage and/or injury. Aperture 206 of heat shield 82 is generally coincident with the perimeter of disk 92 located centrally of support plate 62.

Figure 18:
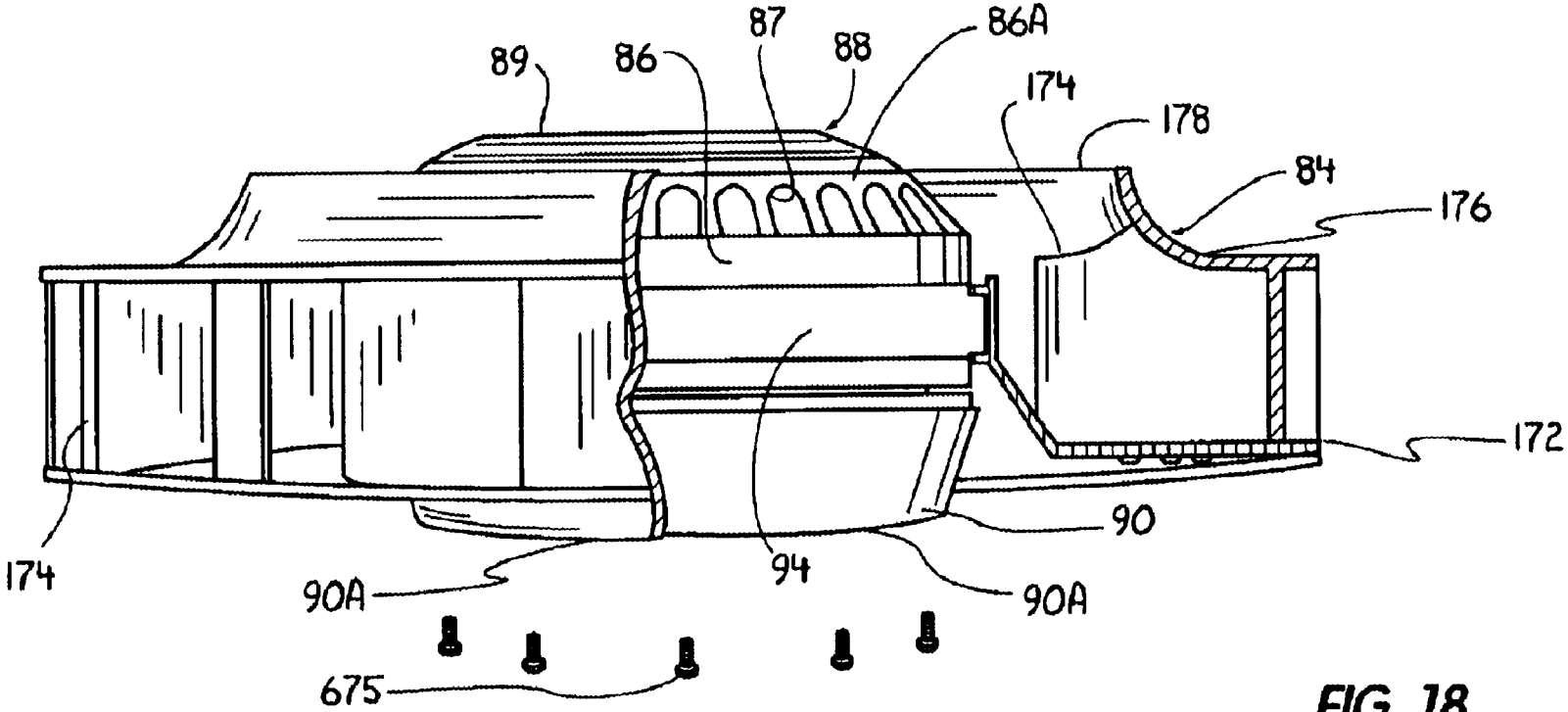
FIG. 18 is a partial cross-sectional view of an impeller and motor of an air recirculating and heating device according to an alternate embodiment of the present invention.

FIG. 18 is a partial cut-away view illustrating further details attendant impeller 84 and motor 88. In particular, rotor 86 includes a plurality of apertures 87 formed in the upper housing; further apertures, not shown, may be formed in top central surface 89. These apertures serve the primary purpose of ventilating motor 88 to prevent a destructive heat build up.

Figure 19:
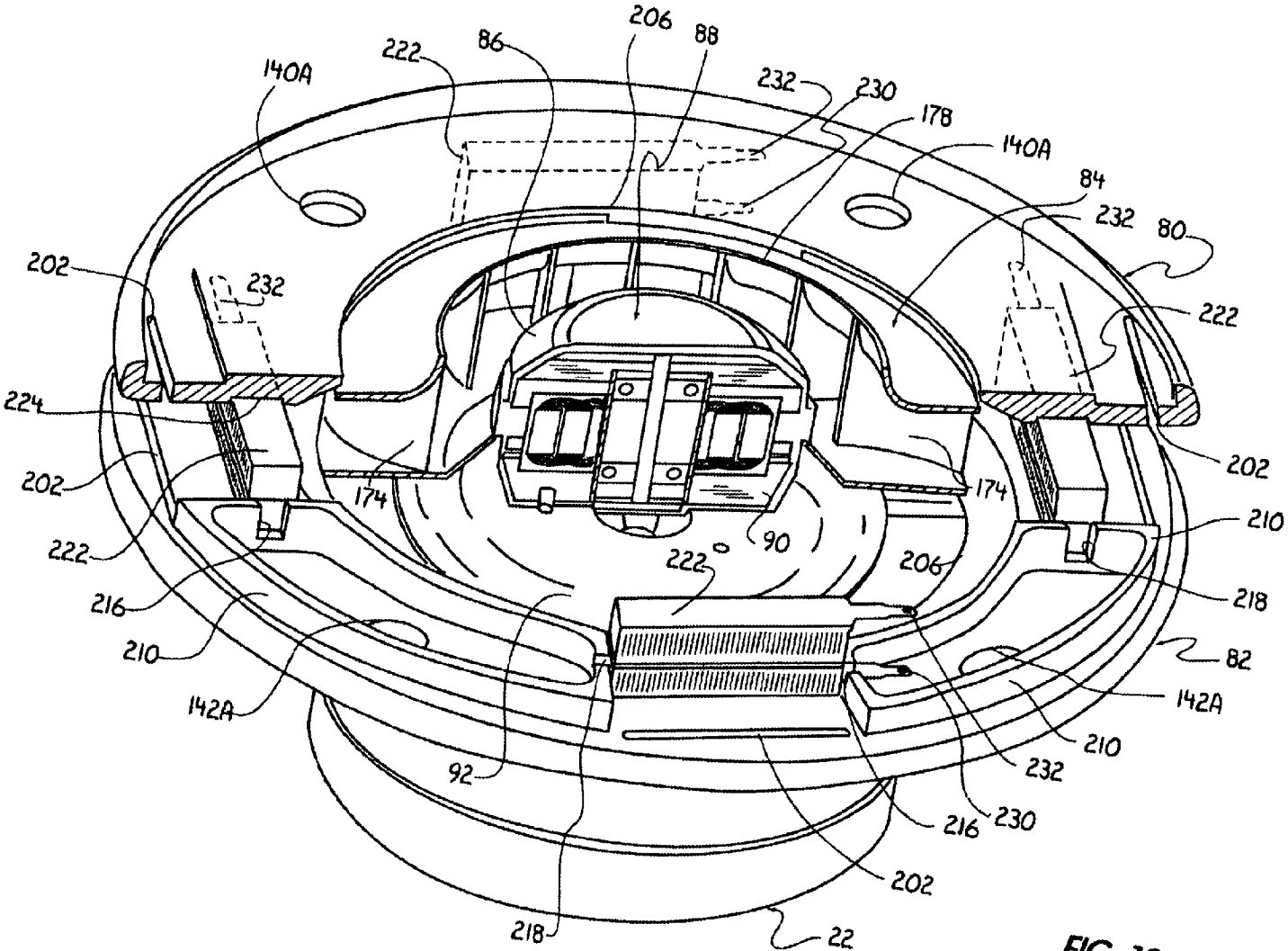
FIG. 19 is a partial cut-away, isometric view of the heating module of an air recirculating and heating device according to an alternate embodiment of the present invention.

FIG. 19 illustrates a partial cut-away view showing the structures intermediate heat shields 80 and 82. Various heat shield designs were evaluated to perform three basic functions: support heating elements 222; prevent the transfer of heat between heating elements 222 and proximate components; and the channeling of the primary airflow. The design in FIG. 19 is but one of many ways to accomplish these tasks. Among those designs evaluated but not limited to were, metal structures with heat sink inserts, full heat sink structure, open architecture and combinations thereof. The chosen design lent to ease of manufacturability but all of the designs, listed above and their equivalence, are within the scope of the invention. More particularly, FIG. 19 shows each of four (4) heating elements 222 retained equiangularly intermediate heat shields 80 and 82. Each of heat shields 80 and 82 includes a depression 224 for nestingly receiving the body of a heating elements 222 (the exposed ones of these depressions are also shown in FIGS. 17B and 17D). Optional disk 92, disposed centrally of opening 206 supports stator 90, and rotor 86 of motor 88 supports impeller 84. It is noted that opening 206 in heat shield 80 is generally coincident with the perimeter of impeller 84. Upon inspection it will become evident that as air is drawn through circular opening 178 of impeller 84, such air flows past motor 88 and will have a cooling effect thereon. The air exhausted by vanes 174 of impeller 84 will be channeled proximal to wall sections 210 of heat shields 80 and 82 and through each of heating elements 222. As described more fully below, some or all of heating elements 222 may be energized and those that are will raise the temperature of the air flowing therethrough. Each of heating elements 222 includes tabs 230 and 232, wherein tabs 230 and 232 are located within respective ones of slots 216 and 218 in wall sections 210 of each of heat shields 80 and 82. As such, retention of heating elements 222 is enhanced by locking action resultant from tabs 230 and 232 being disposed within their respective slots 216 and 218.

Figure 20:
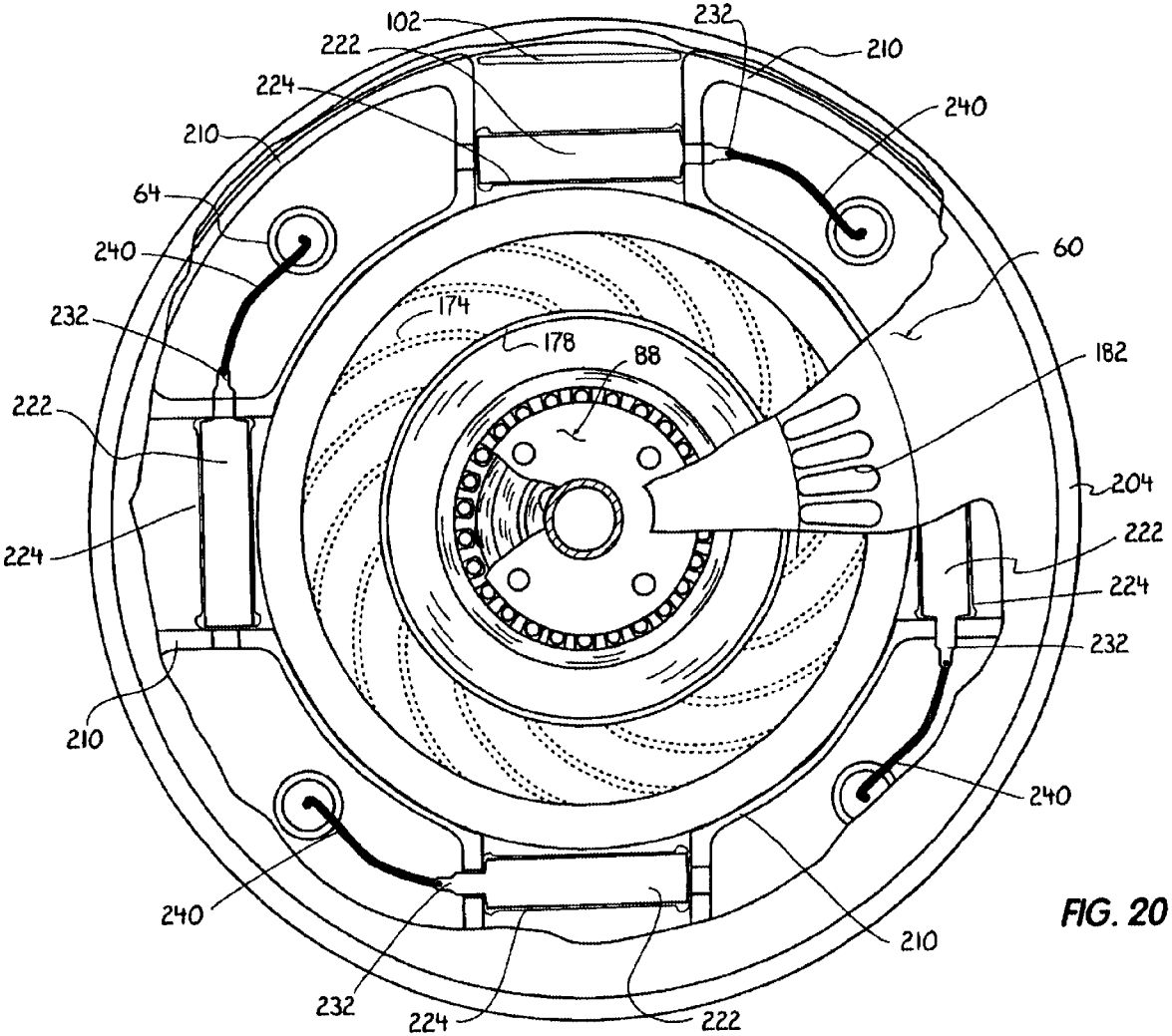
FIG. 20 is a partial cut-away, top view of the heating module of an air recirculating and heating device according to an alternate embodiment of the present invention.

FIG. 20 is a top partial cut-away view of heating module 16 showing the relationships of the various elements disposed therein. Support plate 60 is partially shown along with slots 182 formed therein and the top of pin 64. The perimeter of upper support plate 60 is nestled within lip 204 of heat shield 80. As illustrated, electrical conductors 240 are electrically secured to tabs 230 and 232 (of which only tab 232 is shown) and routed through a central passageway extending through pin 64 as an alternative. Electrical conductors 240 are routed to heating elements 222 via channels disposed in support plate 60, as shown in FIG. 12. An apertured screen 102 is mounted within its slots 202 (see FIG. 19) to prevent physical contact with heating element 222 upstream therefrom. It may also be noted that wall sections 210 on opposed sides of the ends of each heating elements 222 in combination with the connecting surfaces of each heat shield 80 and 82 define the passageway for exhausting the heated primary airflow induced by impeller 84.

Figure 21:
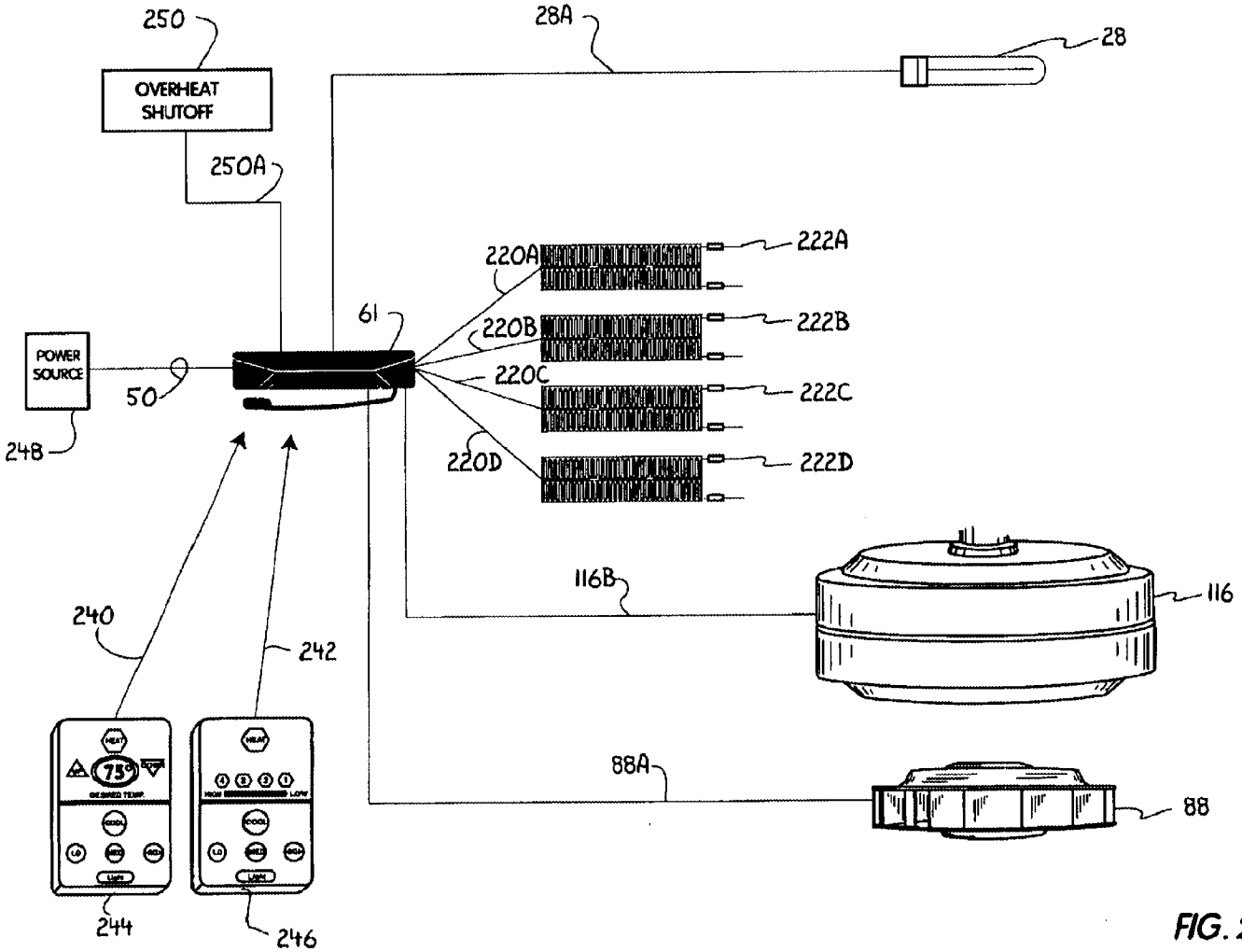
FIG. 21 is a schematic diagram of the control circuitry for an air recirculating and heating device according to an alternate embodiment of the present invention.

Referring now to FIG. 21, there is illustrated a schematic diagram of an apparatus for controlling operation of air recirculating and heating device 110. There are various ways to regulate the amount of heat generated by a heating device. Among them, but not limited to, are analog switches, pull chains, buttons, timers, thermostats, remote control devices, their equivalence or any known means. It should be construed that the manual or automatic remote control devices with their associated remote control receiver unit 61 could be, in alternate embodiments, any or all of the possible ways to regulate, as listed above, and are within the scope of the invention. A remote control receiver unit 61 (see FIG. 12), mounted within cover 12 adjacent a ceiling or other support structure, receives control signals 240 and 242 from a first transmitter 244 or a second transmitter 246. It is to be understood that the functions to be described of transmitters 244 and 246 may be incorporated in a single unit or multitude of units. A source of power 248, such as conventional 120/220-volt alternating current available in all dwellings and office buildings, provides power via conductors 50 to remote control receiver unit 61; or, in an alternate embodiment, remote control receiver unit 61 may be battery or solar operated. Transmitters 244, 246 may be battery powered or hard wired to a source of conventional 120/220-volt alternating current. Remote control receiver unit 61, on command, energizes one or more of heating elements 222 (A, B, C and/or D) via conductors 220 (A, B, C and/or D) under command of transmitters 224 and/or 246. Along with energization of one or more of heating elements 222, motor 88, actuating impeller 84, is energized via conductor 88A to cause a primary airflow 32 to pass through heating elements 100 and exhaust from heating module 16 as primary heated airflow 35. To distribute the primary heated airflow 35 throughout a room, auxiliary fan motor 116 is energized via conductor 116B to cause attached one or more fan blades 124 to provide an upward secondary airflow 34 for mixing with the primary heated airflow 35 and subsequent distribution of the mixture of airflows 36 throughout the room to be heated. If attached, optional lamp assembly 28 can also be energized via conductor 28A by transmitter 244 through remote control receiver unit 61. For safety reasons, an overheat shut-off module 250 may be connected via conductor 250A through remote control receiver unit 61 to cause de-energization of heating elements 222 upon the occurrence of an overheat condition.

Figure 22A:
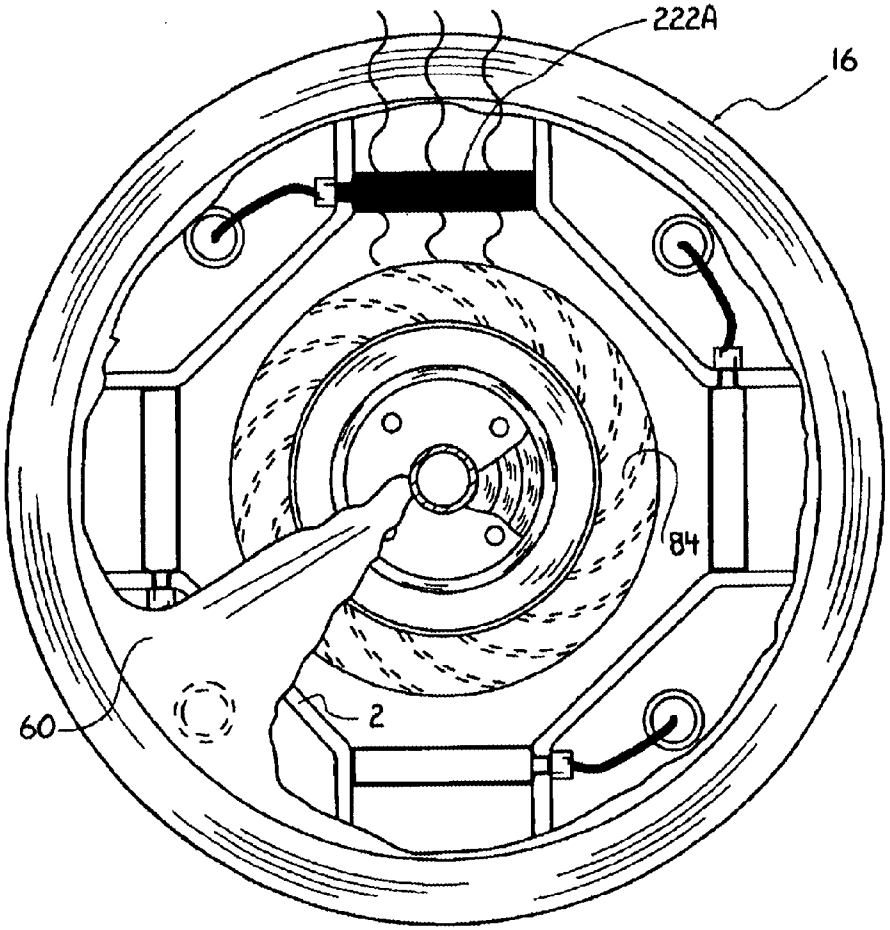
FIGS. 22A, 22B and 22C illustrate the control units and the corresponding actuated heating elements of an air recirculating and heating device according to an alternate embodiment of the present invention.
Figure 22C:
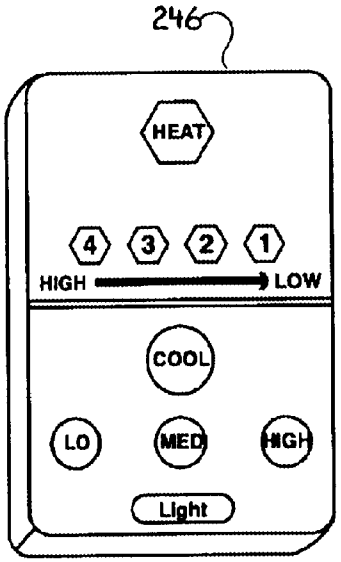
Figure 22B:
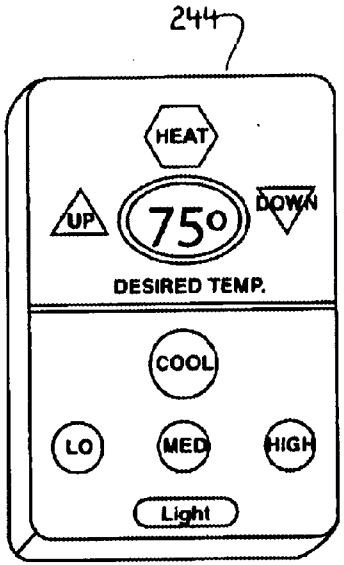

FIGS. 22A, 22B and 22C illustrate operation of transmitters 244 and 246 and the resultant effect on heating module 16. Transmitter 244 includes up/down keys for raising or lowering an indicated desired temperature and works as a thermostat to regulate the number of heating elements 222 actuated. If the room is to be heated, a button or switch marked heat is depressed to actuate rotation of one or more of fan blades 24 of auxiliary fan motor 116 to produce an upward secondary airflow 34. If cooling is desired, a button or switch identified as cool is depressed to result in a downward flow from fan blades 24. Upon initial startup preferred transmitter 244 will activate all heating elements 222 in order to quickly narrow the gap between actual room temperature and desired room temperature. As the gap narrows, heating elements 222 will be automatically deactivated until only the minimum required to maintain the desired temperature are producing heat. As illustrated, desired temperature 75 degrees and actual room temperature are proximal, thereby causing only one heating element 222A to be activated for maintaining the desired condition. Should that condition change, due to an open door or a fall in temperature, additional heating elements 222 will be activated to maintain the desired temperature. The amount of heat generated by heating module 16 is optionally controlled by preferred transmitter 244 and/or 246 if the manual mode of operation is desired by the consumer. Preferred transmitter 246 may include, but not be limited to, four (4) buttons or switches corresponding, respectively, with the number of heating elements 222 (222A–222D) to be energized. As illustrated, button number 1 has been depressed which results in energization of heating element 222A. Upon actuation of impeller 84, air will be passed through heating element 222A and exhausted from the heating module 16 as a primary heated airflow 35 for mixing with the upward secondary airflow 34 generated by fan blade(s) 24 attached to auxiliary fan motor 116.

Figure 23A:
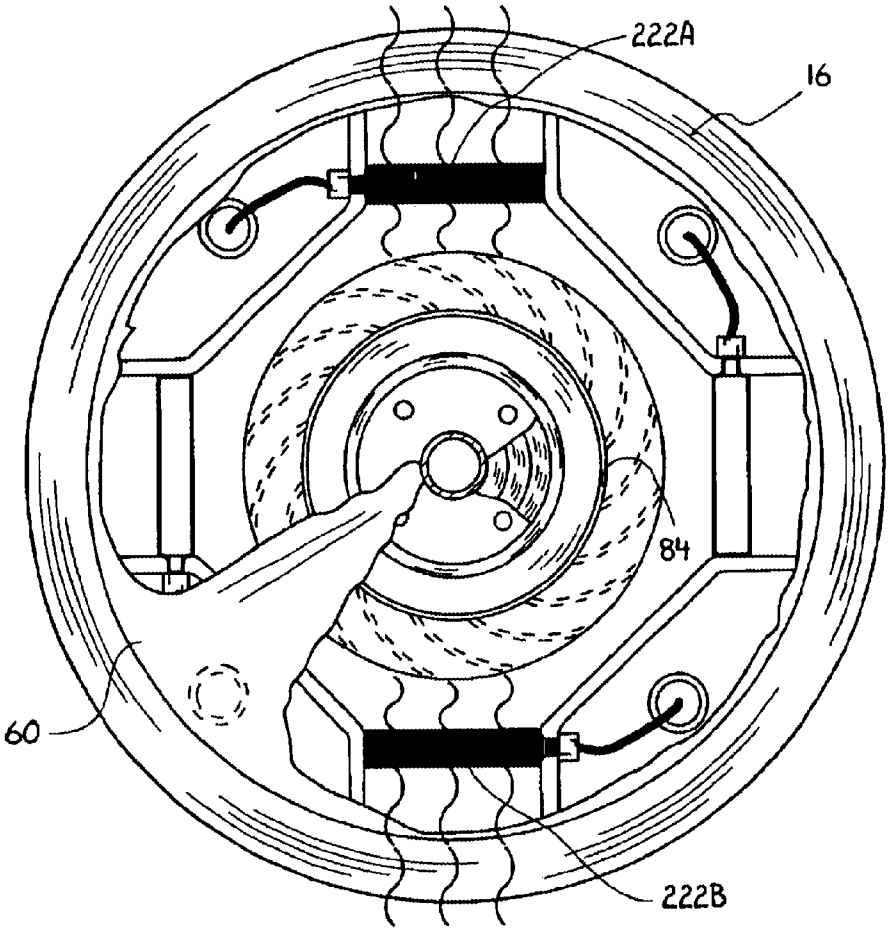
FIGS. 23A, 23B and 23C illustrate the control units and the corresponding actuated heating elements of an air recirculating and heating device according to an alternate embodiment of the present invention.
Figure 23B:
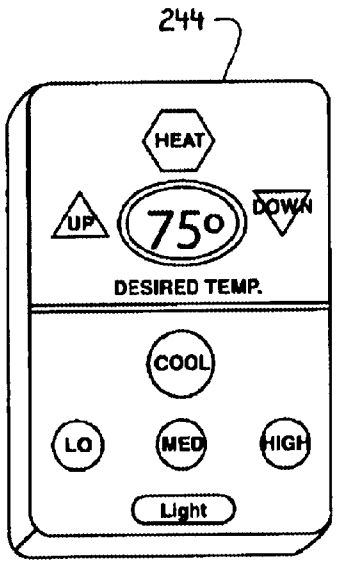
Figure 23C:
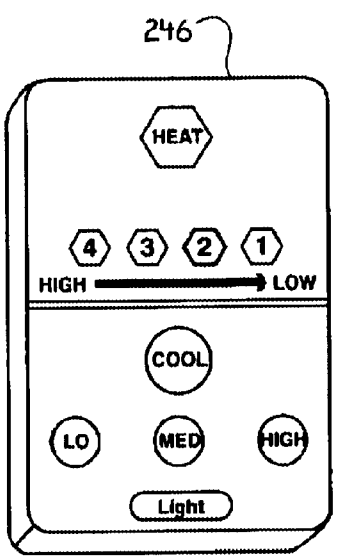
Figure 24A:
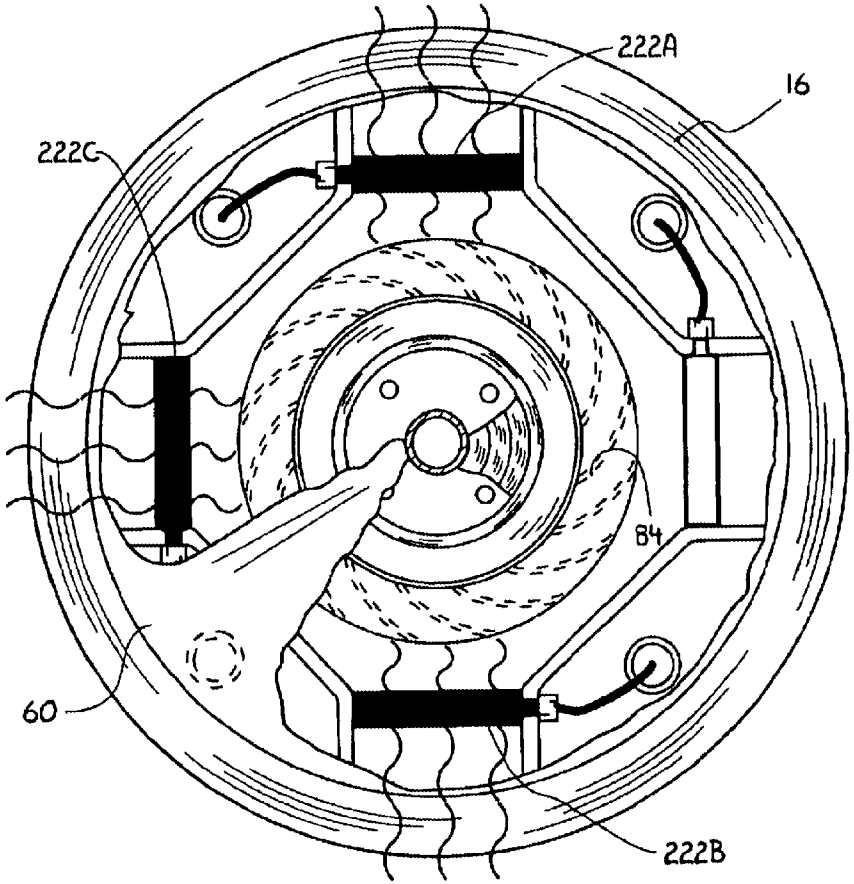
FIGS. 24A, 24B and 24C illustrate the control units and the corresponding actuated heating elements of an air recirculating and heating device according to an alternate embodiment of the present invention.
Figure 24C:
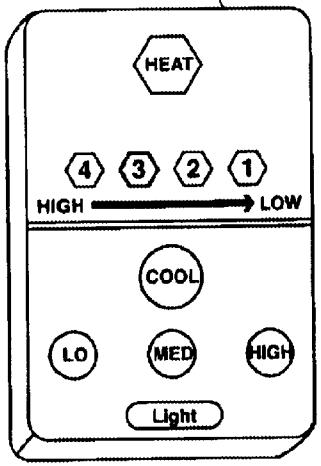
Figure 24B:
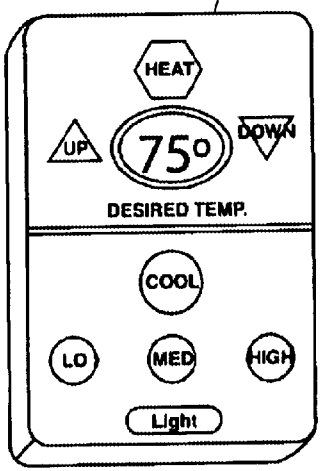
Figure 25A:
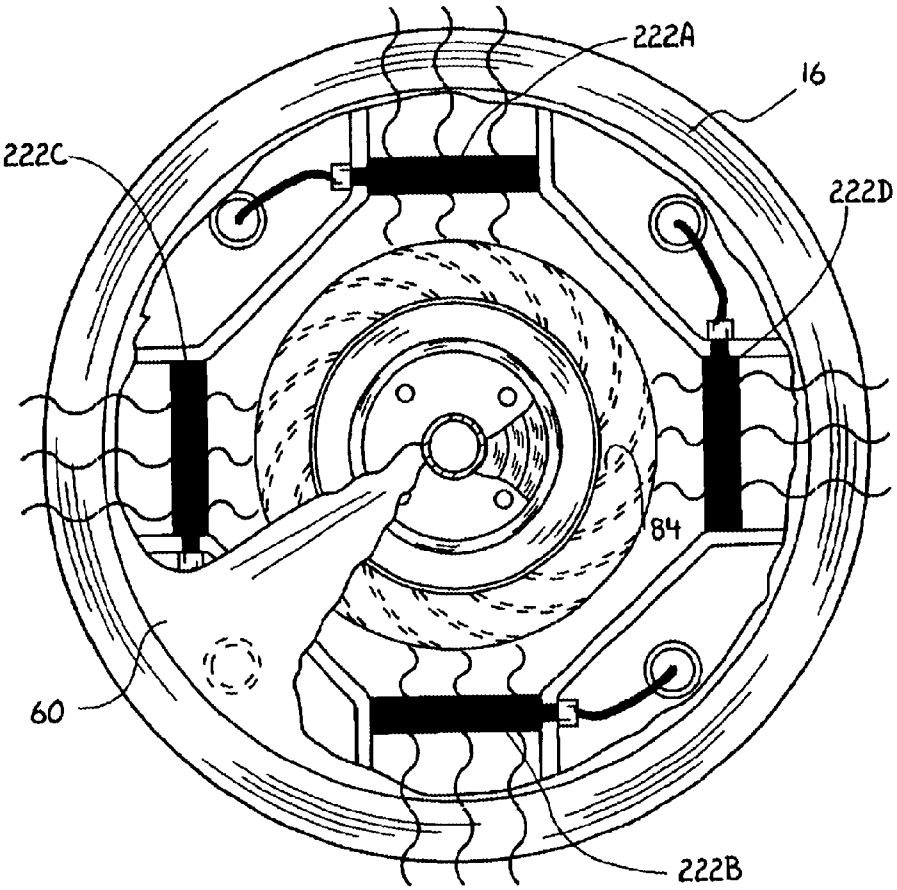
FIGS. 25A, 25B and 25C illustrate the control units and the corresponding actuated heating elements of an air recirculating and heating device according to an alternate embodiment of the present invention.
Figure 25C:
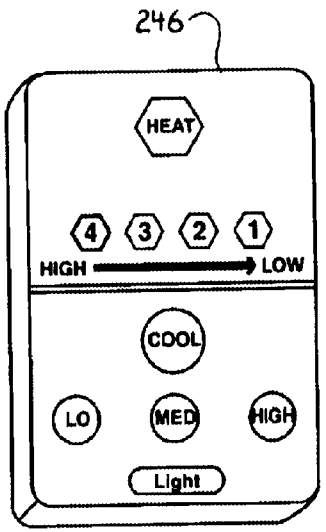
Figure 25B:
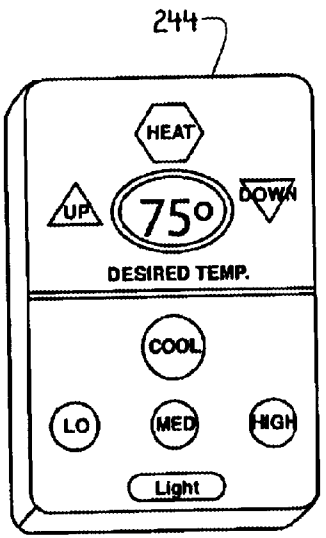

As shown in FIGS. 23A, 23B and 23C, a condition has been established wherein additional heat is to be generated to either increase the rate of temperature rise to the desired temperature or to compensate for some type of heat loss. In this configuration, a button number 2 has been depressed which results in the energizing of heating elements 222A and 222B to provide two heated primary airflows exhausted from heating module 16. To enhance the rate of temperature rise to a desired temperature or to insure maintaining the temperature within a room at the desired temperature, a third heating element may be energized, as illustrated in FIGS. 24A, 24B and 24C. Similarly, FIGS. 25A, 25B and 25C show a condition wherein four (4) heating elements 222 have been energized. Correspondingly, should the automatic transmitter 244 be used to either raise the actual temperature to meet the desired temperature or maintain the desired temperature once achieved, the same configurations in FIGS. 23A, 24A, and 25A will be automatically replicated.

Figure 26:
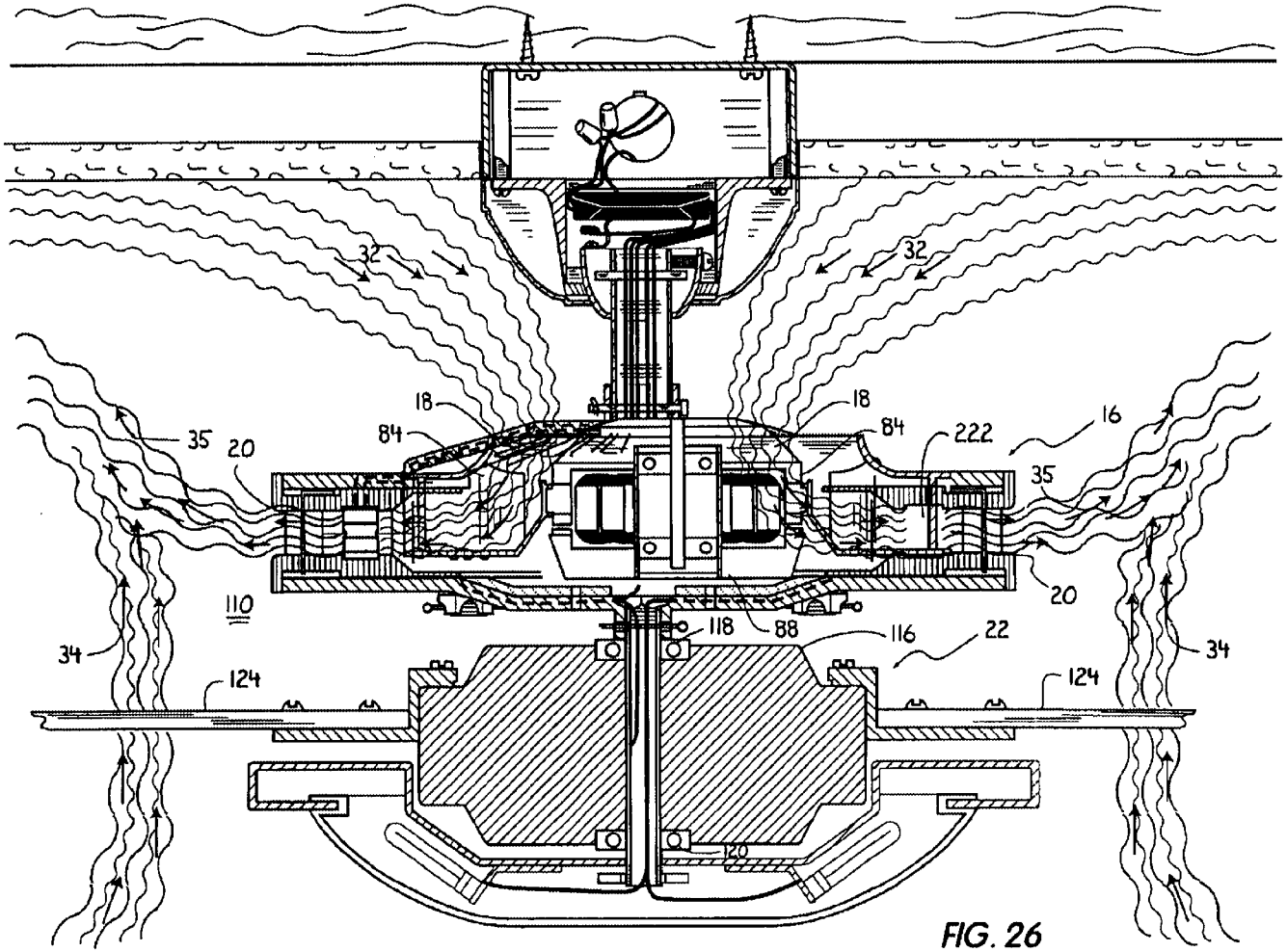
FIG. 26 is an amplification of FIG. 2 and a cross-sectional view of an air recirculating and heating device according to an alternate embodiment of the present invention showing the process of creating the primary airflow and mixing it with the secondary airflow.

Referring now to FIG. 26, which further amplifies the process depicted in FIG. 2, there is illustrated the creation of primary heated airflow 35 upon energization of heating module 16; creation of secondary airflow 34 upon energization of auxiliary fan module 22; and the mixing of primary heated airflow 35 with secondary airflow 34 for distribution throughout the room. Air molecules are moved from the ceiling through inlets 18 through the activation of preferred impeller 84 via preferred motor 88. These moved air molecules are then urged through one or more heating elements 222 for heating prior to being exhausted as a primary heated airflow 35 through one or more outlets 20. Concurrently, the energization of auxiliary fan motor 116, rotates secondary fan blades 24 to create an upward secondary airflow 34. These airflows mix immediately and the primary heated airflow 35 warms upward secondary airflow 34 for subsequent distribution throughout the room. When the warmed secondary upward airflow 34 moves first toward the ceiling, along the ceiling, downwardly along the walls, across the floor and upwardly beneath the air recirculating and heating device 110, one cycle has been completed. These continuous cycles ensure the constant movement of air molecules throughout the room. With each cycle, the warmed air molecules receive additional energy and correspondingly higher temperatures until the room achieves the desired near uniform temperature.

In summary the present invention preferably includes a heating module 16 adapted to an upward location, wherein heating module 16 preferably comprises an upper and a lower support plates 600 and 620, respectively, for housing therebetween one or more heating elements 222 and an air mover for exhausting a primary heated airflow 35 therefrom. Fan blades 24 are rotated by an auxiliary fan motor 116 adapted to support plates 600 and 620 of heating module 16 to create an upward secondary airflow 34 for mixing with primary heated airflow 35 for subsequent distribution of the resulting mixture of airflows 36 throughout a room. An optional lamp assembly 28 may be adapted beneath fan blade 24 to provide illumination in the conventional manner. Control of heating module 16, auxiliary fan motor 116 and optional lamp assembly 28 may be through portable transmitter 247, manually or automatically operated to provide preferably radio frequency transmission to a remote control receiver unit 610.

Although a portable transmitter 247 is preferred, it is contemplated in an alternate embodiment that a fixed wireless transmitter or a fixed hard-wired transmitter may be utilized.

Although preferably the downstream flow of the primary airflow mixes with the downstream flow of the secondary airflow, wherein the secondary airflow is preferably moved upward by the secondary fan, in an alternate less efficient embodiment, the heated downstream flow of the primary airflow mixes with the upstream airflow of the secondary fan, wherein the secondary fan directs airflow downward.

In an alternate embodiment, the primary fan may be reversed such that preferred inlets 18 of heating module 16 become the outlets and the preferred outlets 20 of heating module 16 become the inlets. It is also contemplated that the size, quantity, position and angle of inlets 18 and outlets 20 may vary.

Although one primary fan motor and one secondary fan motor is preferred, additional primary and/or fan motors may be utilized.

It is contemplated that any number of fan blades 24 may be utilized for generating secondary airflow 34. It is also contemplated that other means for generating an airflow may be incorporated.

It is further contemplated that one or more heating elements 222 of various wattage may be utilized to increase the thermal output of the system as is desired for the application or use.

While the invention has been described with reference to several particular embodiments thereof, those skilled in the art will be able to make the various modifications to the described embodiments of the invention without departing from the true spirit and scope of the invention. It is intended that all combinations of elements and steps that perform substantially the same function is substantially the same way to achieve the same result are within the scope of the invention.

I claim:

1. An air recirculating and heating device for heating a room, said device comprising in combination:

a) at least one heating module, comprising:
   i) means for generating a primary airflow, said primary airflow having a downstream flow and an upstream flow relative to said means for generating said primary airflow;
   ii) at least one heating element for heating said primary airflow;
   iii) means for selectively regulating said at least one heating element, wherein said means for selectively regulating is responsive to at least one input for regulating the temperature of said primary airflow; and b) means for generating a secondary airflow, said secondary airflow having a downstream flow and an upstream flow relative to said means for generating said secondary airflow, and wherein said secondary airflow mixes with said heated primary airflow; and c) means for isolating said at least one heating element from said means for generating a secondary airflow.

2. The air recirculating and heating device as set forth in claim 1 wherein said means for generating a primary airflow comprises at least one primary motor operable to rotate at least one primary fan blade.

3. The air recirculating and heating device as set forth in claim 1 wherein said means for generating a secondary airflow comprises at least one secondary motor operable to rotate at least one secondary fan blade.

4. The air recirculating and heating device as set forth in claim 1 further comprising at least one support means.

5. The air recirculating and heating device as set forth in claim 4 wherein said means for generating a secondary airflow is positioned below said at least one heating module.

6. The air recirculating and heating device as set forth in claim 5 wherein said downstream airflow of said primary airflow mixes with said downstream airflow of said secondary airflow.

7. The air recirculating and heating device as set forth in claim 5 wherein said downstream airflow of said primary airflow mixes with said upstream airflow of said secondary airflow.

8. The air recirculating and heating device as set forth in claim 1 wherein said at least one heating module comprises a plurality of said heating elements.

9. The air recirculating and heating device as set forth in claim 8 wherein said heating elements are radially separated.

10. The air recirculating and heating device as set forth in claim 8 wherein said heating module comprises a plurality of inlets and outlets for moving said primary airflow therethrough, and wherein one each of said plurality of heating elements is individually positioned proximal to one each of said plurality of outlets.

11. The air recirculating and heating device as set forth in claim 8 further comprising means for selectively energizing at least one of said plurality of heating elements to control the desired temperature of the room.

12. The air recirculating and heating device as set forth in claim 11 wherein said means for selectively energizing comprises at least one portable remote control unit communicable with said plurality of heating elements.

13. The air recirculating and heating device as set forth in claim 12 wherein said at least one portable remote control unit further comprises a thermostat and controls carried thereby, and wherein a desired room temperature may be set via said controls, and wherein said plurality of heating elements are responsive thereto.

14. The air recirculating and heating device as set forth in claim 12 wherein said at least one portable remote control unit further comprises a display, thermostat and controls carried thereby, and wherein a desired room temperature may be set via said controls and displayed on said display, and wherein said plurality of heating elements are responsive thereto.

15. The air recirculating and heating device as set forth in claim 12 wherein said at least one portable remote control unit is wireless.

16. The air recirculating and heating device as set forth in claim 15 further comprising a wireless receiving unit carried by said at least one heating module and a wireless transmitting unit carried by said at least one portable remote control unit, wherein said wireless transmitting unit transmits a wireless signal detectable by said wireless receiving unit.

17. The air recirculating and heating device as set forth in claim 16 wherein said wireless signal is an infrared frequency.

18. The air recirculating and heating device as set forth in claim 16 wherein said wireless signal is a radio frequency.

19. The air recirculating and heating device as set forth in claim 1, wherein said means for isolating said at least one heating element is at least one heat sink barrier for reducing the transfer of heat from said at least one heating element to said means for generating a secondary airflow.

20. The air recirculating and heating device as set forth in claim 1 wherein said at least one heating module comprises at least one inlet and at least one outlet for moving said primary airflow therethrough.

21. The air recirculating and heating device as set forth in claim 1 further comprising means for filtering said primary airflow.

22. An air recirculating and heating device for heating a room comprising in combination:

a) at least one support means;

b) at least one auxiliary motor;

c) at least one heating module isolated from and mounted upwards of said at least one auxiliary motor, said at least one heating module comprising;

i) at least one motor having at least one primary fan blade adapted for creating a primary airflow;

ii) at least one heating element for heating said primary airflow;

iii) means for adjusting said at least one heating element via at least one input for the purpose of selectively regulating the temperature of said primary airflow; and iv) means for supporting said at least one auxiliary motor; and d) at least one secondary fan blade adapted for rotation by said at least one auxiliary motor to generate an upward secondary airflow for mixing with said heated primary airflow.

23. The air recirculating and heating device as set forth in claim 22 wherein said heating module includes at least one inlet and at least one outlet for moving airflow therethrough.

24. The air recirculating and heating device as set forth in claim 23 wherein said heating module includes more than one of said heating elements and more than one of said outlets.

25. The air recirculating and heating device as set forth in claim 22 wherein at least one of said at least one heating module supports said auxiliary motor and said at least one secondary fan blade.

26. The air recirculating and heating device as set forth in claim 22, wherein said means for adjusting said at least one heating element is an automatic sensing mechanism for automatically sensing the presence of a desired room temperature and for adjusting the operation of said at least one heating module to maintain the room at the desired temperature.

27. The air recirculating and heating device as set forth in claim 22, wherein said means for adjusting said at least one heating element is the manual adjustment of the operation of said at least one heating module to maintain a desired air temperature level in the room.

28. The air recirculating and heating device as set forth in claim 22 including a heat-sink barrier for reducing the transfer of heat between said at least one heating element and proximate elements.

29. The air recirculating and heating device as set forth in claim 22 wherein said at least one heating module is adapted to draw air from an upward location of the room prior to heating the air with said at least one heating element.

30. The air recirculating and heating device as set forth in claim 22 further comprising means for filtering said primary airflow.

31. An air recirculating and heating device for heating a room, said device comprising in combination:

a) at least one support;

b) at least a first motor for rotating at least a first fan blade to warm air from an upward location of the room and to produce a primary airflow;

c) at least one heating element for raising the temperature of the primary airflow produced by said at least one fan blade, wherein said at least one heating element is selectively regulated by at least one input to adjust the temperature of said primary airflow;

d) heat sink material for protecting parts of said device from the adverse effects of heat generated by said at least one heating element; and e) at least a second motor isolated from and mounted downwards of said at least one heating element for rotating at least a second fan blade to urge an upward secondary airflow to mix with the heated primary airflow and distribute the mixed primary and secondary airflows throughout the room.

32. The air recirculating and heating device as set forth in claim 31 including at least one outlet for exhausting the heated primary airflow from said at least one heating element into the room.

33. The air recirculating and heating device as set forth in claim 32 including a plurality of said outlets for directing the heated primary airflow in multiple directions.

34. The air recirculating and heating device as set forth in claim 33 including at least one inlet for introducing air from an upward location to said at least one heating element.

35. The air recirculating and heating device as set forth in claim 31 wherein said first motor, said first fan blade, said at least one heating element and said heat sink material comprise a heating module.

36. The air recirculating and heating device as set forth in claim 35 wherein said heating module includes a means for adapting said at least one second motor.

37. The air recirculating and heating device as set forth in claim 36 wherein said heating module includes at least one inlet for receiving air to be heated and at least one outlet for exhausting the heated primary airflow.

38. The air recirculating and heating device as set forth in claim 31 further comprising means for filtering said primary airflow.

39. An air recirculating and heating device for selectively heating or cooling a room, said device comprising in combination:

a) at least one support;

b) a heating module comprising;

i) means for adapting said heating module in relation with said at least one support; and ii) a means for discharging a heated primary airflow from said heating module, said heating module selectively regulated to adjust the temperature level of said primary airflow;

c) an auxiliary motor adapted in an isolated location downwards of said heating module for rotating at least one fan blade to produce either an upward secondary airflow for heating or a downward secondary airflow for cooling;

d) means for controlling said auxiliary motor to produce either the upward airflow or the downward airflow; and e) heat sink material for protecting at least one element of said device from the adverse effects of heat from said heating module.

40. The air recirculating and heating device as set forth in claim 39 wherein said heating module includes at least one outlet for exhausting the heated primary airflow.

41. The air recirculating and heating device as set forth in claim 39 wherein said heating module includes more than one outlet for exhausting the heated primary airflow.

42. The air recirculating and heating device as set forth in claim 39 wherein said heating module includes at least one inlet for ingress of air to be heated.

43. The air recirculating and heating device as set forth in claim 39 including means for controlling the operation of said auxiliary motor to produce either the upward or the downward secondary airflow.

44. The air recirculating and heating device as set forth in claim 43 wherein said control means regulates the amount of heat produced by said heating module commensurate with upward secondary airflow to achieve a desired temperature of the air in the room.

45. The air recirculating and heating device as set forth in claim 39 further comprising means for filtering said primary airflow.

46. A method for heating a room with an air recirculating and heating device, said method comprising the steps of:

a) drawing air from an upward location of the room through an inlet into a heating module in response to rotation of at least one motorized impeller;

b) producing with the at least one motorized impeller a primary airflow;

c) heating said primary airflow with at least one heating element and selectively regulating the amount of heat generated by said at least one heating element before exhausting the heated primary airflow through at least one outlet;

d) generating an upwardly directed secondary airflow with at least one fan blade adapted to rotate in response to at least one auxiliary motor and mixing the second airflow with the heated primary airflow; and e) distributing the mixture of heated primary airflow and secondary airflow in a toroidal pattern throughout the room.

47. The method as set forth in claim 46 wherein said step of distributing includes the step of raising temperature of any window glass in the room to reduce the presence of cold spots and to promote a near uniform air temperature throughout the room.

48. The method as set forth in claim 46 further comprising the step of filtering said primary airflow.

49. An air recirculating and heating device for heating a room, said device comprising in combination:

a) at least one support;

b) a heating module, said heating module comprising at least one motorized impeller and at least one selectively regulated heating element for producing a selectively regulated heated primary airflow;

c) at least one auxiliary motor mounted downwards of and isolated from said heating module;

d) at least one fan blade rotatably operative upon energization of said at least one auxiliary motor to generate an upward secondary airflow for mixing with and distributing said heated primary airflow; and e) means for housing at least one of:

i) said heating module; and ii) said at least one motorized impeller.

50. The air recirculating and heating device as set forth in claim 49 wherein said housing means houses at least said at least one heating module and including at least one inlet for introducing air into said housing means and at least one outlet for exhausting the heated primary airflow from said housing means.

51. The air recirculating and heating device as set forth in claim 50 wherein said heating module contains more than one of said at least one heating elements for further heating the primary airflow.

52. The air recirculating and heating device as set forth in claim 51 including means for selectively energizing at least one of said at least one heating element to bring about a desired air temperature in the room.

53. The air recirculating and heating device as set forth in claim 49 including means for actuating said auxiliary motor to direct a downward secondary airflow to bring about a cooling effect.

54. The air recirculating and heating device as set forth in claim 53 wherein said means for actuating said auxiliary motor is a wireless device.

55. The air recirculating and heating device as set forth in claim 49 further comprising means for filtering said primary airflow.

56. An air recirculating and heating device for heating a room comprising in combination:

a) at least one support means;

b) a heating module for generating a heated primary airflow;

c) at least one auxiliary motor mounted in an isolated location downwards of said heating module, said at least one auxiliary motor having at least one fan blade for generating an upward secondary airflow for mixing with said heated primary airflow; and d) means for selectively regulating the amount of heat generated by said heating module.

57. The air recirculating and heating device as set forth in claim 56 wherein said heating module comprises at least one motorized impeller and at least one heating element.

58. The air recirculating and heating device as set forth in claim 56 wherein said heating module includes at least one inlet for introducing air to be heated.

59. The air recirculating and heating device as set forth in claim 56 wherein said heating module includes at least one outlet for exhausting the heated primary airflow.

60. The air recirculating and heating device as set forth in claim 56 wherein said means for selectively regulating automatically senses the temperature desired of the air in the room and regulates said heating module to maintain the air in the room at the desired temperature.

61. The air recirculating and heating device as set forth in claim 56 wherein said means for selectively regulating accommodates manual regulation of said heating module to maintain the air in the room at a desired temperature.

62. The air recirculating and heating device as set forth in claim 56 including a heat sink barrier for reducing the transfer of heat from said at least one heating element to selected elements of said device.

63. The air recirculating and heating device as set forth in claim 56 wherein said heating module includes at least one inlet for accommodating an inflow of air to be heated by said at least one heating element from an upward location of the room.

64. The air recirculating and heating device as set forth in claim 56 further comprising means for filtering said primary airflow.

65. A method for heating a room with an air recirculating and heating device, said method comprising the steps of:

a) producing a heated primary airflow with a heating module having at least one motorized impeller for drawing air from an upward location of the room and at least one heating element for heating the drawn air;

b) generating an upward second airflow for mixing with the heated primary airflow with at least one auxiliary motor adapted to rotate at least one fan blade;

c) said step of generating including the step of circulating the mixed heated primary and secondary airflows in a toroidal path through the room; and d) said step of producing including the step of selectively regulating the heat of said at least one heating element to regulate the amount of heat added to the primary airflow.

66. The method as set forth in claim 65 including the step of distributing the heated primary airflow through at least one outlet.

67. The method as set forth in claim 65 wherein said step of regulating is manually operable to set a desired temperature for the air in the room to automatically regulate the heat of the heating module to maintain the desired air temperature.

68. The method as set forth in claim 65 wherein said step of regulating is manually operable to set a desired temperature level in the room to maintain a desired comfort level within the room.

69. The method as set forth in claim 65 further comprising the step of filtering said primary airflow.

70. An air recirculating and heating device for heating a room comprising in combination:

a) at least one support means;

b) a heating module, said heating module comprising:

i) at least two heating elements;

ii) at least one motorized impeller adapted to draw air from an upward location of the room to create a primary airflow, wherein said at least one motorized impeller urges said primary airflow through said at least two heating elements to create a heated primary airflow;

iii) at least two outlets for exhausting said heated primary airflow, wherein said heat primary airflow is exhausted through said at least two outlets via said at least one motorized impeller in multiple directions;

iv) means for supporting at least one auxiliary motor, wherein said at least one auxiliary motor is adapted to rotate at least one fan blade upon energization for the creation of an upward secondary airflow for mixing with said heated primary airflow to produce a heated airflow mixture for distribution throughout the room, said at least one auxiliary motor mounted in an isolated location downward from said heating module; and c) means for selectively regulating the amount of heat provided by said at least two heating elements to regulate the temperature of said heated airflow mixture.

71. An air recirculating and heating device as set forth in claim 70 wherein said at least one heating module includes a load-bearing element capable of supporting at least said at least one auxiliary motor.

72. An air recirculating and heating device as set forth in claim 71 including a light assembly.

73. The air recirculating and heating device as set forth in claim 70 further comprising means for filtering said primary airflow.

74. An air recirculating and heating device for heating a room comprising in combination:

a) support means;

b) a heating module engaged with said support means for drawing air from an upward location of the room, for heating the air and for creating a heated primary airflow selectively regulated by at least one input to adjust the temperature of said heated primary airflow;

c) an auxiliary motor isolated and adapted downward from said heating module, wherein said auxiliary motor rotates at least one fan blade to create an upward secondary airflow.

75. The air recirculating and heating device as set forth in claim 74 wherein said heating module includes a load bearing element adapted to interconnect said support means with said auxiliary motor.

76. The air recirculating and heating device as set forth in claim 65 wherein said heating module includes at least one heating element and a motorized impeller for creating the primary airflow by drawing air from an upward location and urging the air through said at least one heating element.

77. The air recirculating and heating device as set forth in claim 76 wherein said heating module includes at least one inlet for channeling the air to said motorized impeller.

78. The air recirculating and heating device as set forth in claim 76 wherein said heating module includes at least one outlet for exhausting the heated primary airflow.

79. The air recirculating and heating device as set forth in claim 76 wherein said motorized impeller urges the heated primary airflow into the path of the upward secondary airflow to mix the primary and secondary airflow prior to circulation of the mixed airflows throughout the room.

80. The air recirculating and heating device as set forth in claim 74 further comprising means for filtering said primary airflow.

81. An air recirculating and heating device for heating a room comprising in combination:

a) at least one support means;

b) a heating module adapted to said at least one support means for creating a selectively regulated heated primary airflow responsive to at least one input; and c) an auxiliary motor for rotating at least one fan blade to create an upward secondary airflow for mixing with the heated primary airflow and for distributing the mixed airflows throughout the room and adjacent any window glass present to raise the temperature of the window glass by conductive heat transfer between the mixed airflows and the surface of the window glass, wherein said auxiliary motor is mounted downward and isolated from said heating module.

82. The air recirculating and heating device as set forth in claim 81 including at least one motorized impeller for drawing air from an upward location of the room and for creating the primary airflow.

83. The air recirculating and heating device as set forth in claim 82 including at least one heating element for heating the air to increase the temperature of the primary airflow prior to mixing of the heated primary airflow with the secondary airflow.

84. The air recirculating and heating device as set forth in claim 81 wherein the raised temperature of the window glass both reduces the cold spots adjacent the window and helps create a more nearly uniform air temperature throughout the room.

85. The air recirculating and heating device as set forth in claim 82 including means for controlling the heat output of said heating module to maintain the air in the room at a comfortable temperature.

86. The air recirculating and heating device as set forth in claim 81 further comprising means for filtering said primary airflow.

87. An air recirculating and heating device for heating a room, said device comprising in combination:

a) at least one heating module, comprising:

i) means for generating a primary airflow, said primary airflow having a downstream flow and an upstream flow relative to said means for generating said primary airflow;

ii) at least a first heating element and at least a second heating element selectively regulated by at least one input for heating said primary airflow to an adjusted temperature level; and b) means for generating a secondary airflow, said secondary airflow having a downstream flow and an upstream flow relative to said means for generating said secondary airflow, wherein said secondary airflow mixes with said heated primary airflow, and wherein said means for generating a secondary airflow is positioned downward and isolated from said at least one heating module.

88. The air recirculating and heating device as set forth in claim 87 wherein said first heating element is juxtaposed with said second heating element.

89. The air recirculating and heating device as set forth in claim 87 further comprising means for filtering said heated primary airflow.

90. The air recirculating and heating device as set forth in claim 89 wherein said means for filtering said primary airflow is a filter positioned in the path of said upstream flow of said primary airflow.

91. The air recirculating and heating device as set forth in claim 89 wherein said means for filtering said primary airflow is a filter positioned in the path of said downstream flow of said primary airflow.

92. A method for heating a room with an air recirculating and heating device, said method comprising the steps of:

a) drawing air from an upward location of the room through an inlet into a heating module in response to rotation of at least one motorized fan;

b) producing with the at least one motorized fan a primary airflow;

c) heating the primary airflow with at least a first heating element and at least a second heating element and selectively regulating the amount of heat generated by said at least a first heating element and said at least a second heating element before exhausting the heated primary airflow through at least one outlet;

d) generating an upwardly directed secondary airflow with at least one fan blade adapted to rotate in response to at least one auxiliary motor isolated from and mounted downwards of said heating module, and mixing said secondary airflow with said heated primary airflow; and e) distributing the mixture of said heated primary airflow and said secondary airflow throughout the room.

93. The method of claim 92 wherein said at least first heating element and said at least second heating element are juxtaposed, thereby creating at least a first heating phase and at least a second heating phase, wherein said first heating phase preheats said primary airflow, and wherein said second heating phase further heats said preheated primary airflow.

94. The method as set forth in claim 92 further comprising the step of filtering said primary airflow.

95. An air recirculating and heating device for heating a room, comprising in combination:

a) at least one support means;

b) at least one auxiliary motor;

c) at least one heating module mounted in upward isolation from said at least one auxiliary motor, said at least one heating module comprising;

i) at least one motor having at least one primary fan blade adapted for creating a primary airflow; and ii) at least one heating element for heating said primary airflow;

iii) means for selectively regulating said at least one heating element to adjust the temperature of said primary airflow; and d) at least one secondary fan blade adapted for rotation by said at least one auxiliary motor to generate an upward secondary airflow for mixing with said primary heated airflow to create a near uniform temperature throughout the room.

96. An air recirculating, heating, reheating and temperature maintenance device for heating a room, comprising in combination:

a) at least one support means;

b) means for drawing risen air from an upward location of a room for heating and reheating, said means for drawing risen air comprising:

i) at least one heating module;

ii) at least one motor for rotating at least one fan blade for creating a primary flow of heated air; and iii) at least one secondary fan blade adapted for rotation by at least one auxiliary motor to generate an upward secondary airflow of ambient room air for mixing with said primary flow of heated air prior to distribution, in a toroidal pattern, throughout the room to create an elevated near uniform room temperature; and c) at least one control unit that selectively regulates the amount of said primary flow of heated air created by said heating module when a set desired temperature is reached and then causes said heating module to introduce only enough of said primary flow of heated air to said secondary airflow to maintain the desired temperature in the room.

97. The air recirculating, heating, reheating and temperature maintenance device as set forth in claim 96 wherein said heating module is automatically adjusted to introduce the required heated airflow to ensure room temperature does not fluctuate.

98. The air recirculating, heating, reheating and temperature maintenance device as set forth in claim 96 wherein said toroidal pattern distributes heated air in near even distribution throughout the room.

99. An air recirculating and heating device for heating a room comprising in combination:

a) means to create a circular airflow that distributes air evenly throughout a room;

b) means to create a heated airflow for mixing with said circular airflow for distribution resulting in near even temperatures throughout the room; and c) means to selectively regulate said heated airflow to maintain a desired near even temperature throughout the room.

* * * * *